US010920362B2

(12) United States Patent
Cho

(10) Patent No.: US 10,920,362 B2
(45) Date of Patent: Feb. 16, 2021

(54) LATCH LOCK AND HOME APPLIANCE INCLUDING THE SAME

(71) Applicant: LG ELECTRONICS INC., Seoul (KR)

(72) Inventor: Kichul Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 681 days.

(21) Appl. No.: 15/626,667

(22) Filed: Jun. 19, 2017

(65) Prior Publication Data

US 2017/0362766 A1 Dec. 21, 2017

(30) Foreign Application Priority Data

Jun. 20, 2016 (KR) ..... 10-2016-0076848

(51) Int. Cl.
*D06F 39/14* (2006.01)
*E05C 19/02* (2006.01)
(Continued)

(52) U.S. Cl.
CPC ..... *D06F 39/14* (2013.01); *D06F 37/28* (2013.01); *E05C 3/122* (2013.01); *E05C 19/022* (2013.01);
(Continued)

(58) Field of Classification Search
CPC ..... Y10T 292/0863; Y10T 292/0864; Y10T 292/0867; Y10T 292/0868; Y10T 292/0997; Y10T 292/444; Y10T 292/0951; Y10T 292/1001; Y10T 292/1028; Y10T 292/0945; Y10T 292/0947; Y10T 292/696;
(Continued)

(56) References Cited

U.S. PATENT DOCUMENTS 2,146,379 A * 2/1939 Rediger ..... E05C 3/24 292/198
2,637,576 A * 5/1953 Nottingham ..... E05C 19/022 292/99
(Continued)

FOREIGN PATENT DOCUMENTS

CN 201567870 9/2010
CN 103874796 6/2014
(Continued)

OTHER PUBLICATIONS

European Search Report dated Nov. 16, 2017 issued in Application No. 17175044.1.
(Continued)

*Primary Examiner* — Kristina R Fulton
*Assistant Examiner* — Faria F Ahmad
(74) *Attorney, Agent, or Firm* — KED & Associates LLP

(57) ABSTRACT

A lock including a latch provided at one of a door and a cabinet, and a coupler provided at the other one of the door and the cabinet, the coupler including a housing including a latch insertion hole, an engaging lever including an engaging lever body rotatably provided within the housing, a latch insertion groove having a first end of the latch inserted therein by extending from a first end of the engaging part body, and first, second, third, and fourth projections formed by extending a second end of the engaging lever body.

17 Claims, 18 Drawing Sheets

(51) Int. Cl.

| | |
|---|---|
| ***D06F 37/28*** | (2006.01) |
| ***E05C 3/12*** | (2006.01) |
| ***E05B 63/00*** | (2006.01) |
| ***E05B 47/00*** | (2006.01) |
| ***D06F 37/42*** | (2006.01) |

(52) U.S. Cl.
CPC ..... *D06F 37/42* (2013.01); *E05B 63/0069* (2013.01); *E05B 2047/0068* (2013.01); *E05C 19/024* (2013.01); *Y10T 292/0863* (2015.04); *Y10T 292/0864* (2015.04); *Y10T 292/0867* (2015.04); *Y10T 292/0868* (2015.04); *Y10T 292/0932* (2015.04); *Y10T 292/0945* (2015.04); *Y10T 292/0947* (2015.04); *Y10T 292/0951* (2015.04); *Y10T 292/0959* (2015.04); *Y10T 292/0997* (2015.04); *Y10T 292/1001* (2015.04); *Y10T 292/1021* (2015.04); *Y10T 292/1028* (2015.04); *Y10T 292/1051* (2015.04); *Y10T 292/1061* (2015.04); *Y10T 292/1078* (2015.04); *Y10T 292/305* (2015.04); *Y10T 292/444* (2015.04); *Y10T 292/696* (2015.04); *Y10T 292/702* (2015.04)

(58) Field of Classification Search
CPC ..... Y10T 292/702; Y10T 292/1078; Y10T 292/1051; Y10T 292/0932; Y10T 292/0933; Y10T 292/1021; Y10T 292/18; Y10T 292/0959; Y10T 292/305; Y10T 292/1061; Y10S 292/04; Y10S 292/37; Y10S 292/69; E05C 3/16; E05C 3/122; E05C 19/022; E05C 19/024; D06F 39/14; D06F 37/28; D06F 37/42; E05B 63/0069; E05B 2047/0068
See application file for complete search history.

(56) References Cited

U.S. PATENT DOCUMENTS

| | | | | | |
|---|---|---|---|---|---|
| 2,676,047 | A * | 4/1954 | Gould | E05C 3/24 | 292/229 |
| 3,592,496 | A * | 7/1971 | Ploughman | E05B 85/243 | 292/216 |
| 3,667,793 | A * | 6/1972 | Varrin et al. | E05C 3/24 | 292/216 |
| 4,163,443 | A * | 8/1979 | Peterson | E05C 5/00 | 126/197 |
| 4,593,945 | A * | 6/1986 | Arute | F24C 15/022 | 292/201 |
| 4,655,489 | A * | 4/1987 | Bisbing | E05C 19/022 | 292/110 |
| 4,745,250 | A * | 5/1988 | Mayo | H01H 3/163 | 219/722 |
| 4,960,297 | A * | 10/1990 | Bouse | E05C 3/162 | 126/197 |
| 4,988,132 | A * | 1/1991 | Rocchitelli | D06F 37/42 | 292/144 |
| 5,012,794 | A * | 5/1991 | Faurel | E05C 5/00 | 126/191 |
| 5,072,974 | A * | 12/1991 | Henne | E05C 19/022 | 292/126 |
| 5,401,067 | A * | 3/1995 | Kurosaki | E05C 5/00 | 292/63 |
| 6,155,616 | A * | 12/2000 | Akright | E05B 5/00 | 292/198 |
| 6,315,336 | B1 * | 11/2001 | Swartzell | E05B 47/0012 | 292/201 |
| 6,913,296 | B2 * | 7/2005 | Bassi | A47L 15/4259 | 292/122 |
| 7,201,409 | B2 * | 4/2007 | Adachi | E05B 17/0041 | 292/101 |
| 7,210,712 | B2 * | 5/2007 | Artsiely | E05B 17/2007 | 292/109 |
| 7,306,266 | B2 * | 12/2007 | Hapke | A47L 15/4259 | 292/192 |
| 7,347,460 | B2 * | 3/2008 | Ala | A47L 15/4259 | 292/216 |
| 7,481,469 | B2 * | 1/2009 | Harrer | F24C 15/022 | 292/201 |
| 7,775,565 | B2 * | 8/2010 | Hartmann | E05C 3/24 | 292/60 |
| 7,938,765 | B2 * | 5/2011 | Hayasaka | E05B 17/0029 | 494/12 |
| 7,956,304 | B2 * | 6/2011 | Bacigalupe | H01H 9/226 | 200/334 |
| 8,152,207 | B2 * | 4/2012 | Hartmann | E05B 63/20 | 292/95 |
| 8,646,816 | B2 * | 2/2014 | Dziurdzia | E05B 17/0029 | 292/201 |
| 8,733,802 | B2 * | 5/2014 | Promutico | D06F 37/28 | 292/57 |
| 9,273,425 | B2 * | 3/2016 | Kim | D06F 37/42 | |
| 9,370,294 | B2 * | 6/2016 | Osvatic | E06B 5/006 | |
| 10,119,312 | B2 * | 11/2018 | Wang | A47L 15/4259 | |
| 10,196,843 | B2 * | 2/2019 | Hickman | E05C 1/02 | |
| 10,240,372 | B2 * | 3/2019 | Dirnberger | E05B 47/0603 | |
| 2003/0041852 | A1 * | 3/2003 | Ramsey | F24C 15/022 | 126/197 |
| 2003/0127866 | A1 * | 7/2003 | Martinez | E05B 17/0029 | 292/216 |
| 2003/0160461 | A1 * | 8/2003 | Promutico | E05C 5/00 | 292/216 |
| 2003/0218339 | A1 * | 11/2003 | Bassi | E05C 19/024 | 292/138 |
| 2004/0182856 | A1 * | 9/2004 | Lee | H05B 6/6417 | 219/739 |
| 2005/0121918 | A1 * | 6/2005 | Smock | F24C 15/022 | 292/109 |
| 2006/0012187 | A1 * | 1/2006 | Adachi | E05B 17/0041 | 292/304 |
| 2006/0255599 | A1 * | 11/2006 | Su | E05C 19/022 | 292/304 |
| 2007/0241568 | A1 * | 10/2007 | Harrer | H05B 6/6417 | 292/144 |
| 2007/0294893 | A1 * | 12/2007 | Chou | A45F 5/00 | 30/28 |
| 2014/0035294 | A1 * | 2/2014 | Promutico | D06F 37/42 | 292/98 |
| 2015/0052728 | A1 * | 2/2015 | Alexander | E05B 47/0009 | 29/428 |
| 2016/0168878 | A1 | 6/2016 | Fischer | | |

FOREIGN PATENT DOCUMENTS

| | | |
|---|---|---|
| CN | 104662219 | 5/2015 |
| CN | 105671869 | 6/2016 |
| DE | 43 43 975 | 6/1995 |
| EP | 2 087 829 | 8/2009 |
| WO | WO 2012/042551 | 4/2012 |
| WO | WO 2012/123980 | 9/2012 |

OTHER PUBLICATIONS

Chinese Office Action (with English translation) dated Dec. 17, 2018 issued in CN Application No. 201710449948.9.

* cited by examiner

LATCH LOCK AND HOME APPLIANCE INCLUDING THE SAME

CROSS-REFERENCE TO RELATED APPLICATION(S)

Pursuant to 35 U.S.C. § 119(a), this application claims the benefit of Korean Patent Application No. 10-2016-0076848, filed on Jun. 20, 2016, which is hereby incorporated by reference as if fully set forth herein.

BACKGROUND

1. Field

A latch lock and home appliance including a lock are disclosed herein.

2. Background

A home appliance may include a cabinet forming an exterior, a storage space provided within the cabinet, an opening provided at the cabinet so as to communicate with the storage space, and a door provided rotatably to the cabinet so as to open/close the opening. A general home appliance may include a lock to open/close the door. The lock may include a latch provided at one of the door and the cabinet and a coupling part provided at the other so as to be detachably coupled with the latch.

As a handle is provided at a front side of the door of the related art lock having the above-mentioned configuration in order to open/close the door, a user may open/close the door by holding the handle. However, if both hands are not usable, the user may not be able to open/close the door.

BRIEF DESCRIPTION OF THE DRAWINGS

The embodiments will be described in detail with reference to the following drawings in which like reference numerals refer to like elements wherein.

DETAILED DESCRIPTION

Figure 1:
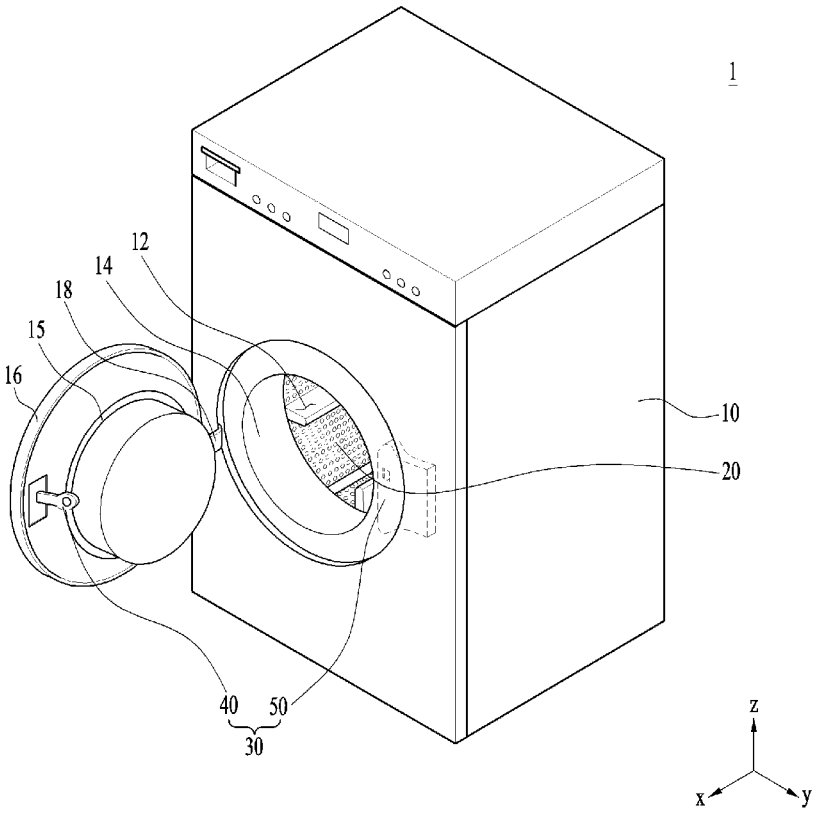
FIG. 1 is a diagram showing a case where a home appliance including a lock is a washing machine.

The present disclosure relates to a locker or lock 30, which may detachably fix a door 15 to a cabinet 10 having an entrance 14, and a home appliance. FIG. 1 is a diagram showing a case where a home appliance including a lock is a washing machine. Although a lock of the present disclosure may be provided at various home appliances as well as to a washing machine, for clarity, the present disclosure shall be described with reference to a case where a home appliance including a lock is a washing machine.

Referring to FIG. 1, a washing machine corresponding to a home appliance may include a cabinet 10 forming an exterior, a storage space 12 provided within the cabinet 10, an entrance or opening 14 provided at the cabinet 10 so as to communicate with the storage space 12, and a door 16 rotatably provided at the cabinet 10 so as to open/close the entrance 14. A laundry holding part 20 capable of holding laundry and the like may be provided within the storage space 12. The laundry holding part 20 may include a tub configured to store wash water and a drum rotatably provided within the tub so as to store laundry.

A hinge 18 for connecting the door 16 to the cabinet may be provided. The hinge 18 may be connected to one side of the door 16 and a front side of the cabinet 10 configuring a circumference of the entrance 14.

Figure 2:
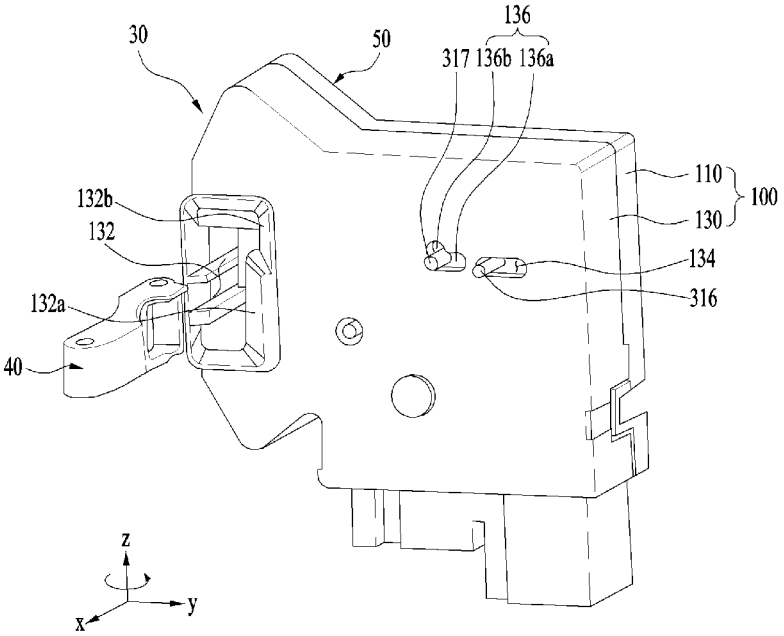
FIG. 2 is a diagram showing a lock according to an embodiment of the present disclosure.

Referring to the orthogonal coordinates system shown in FIG. 2, a positive direction of an x-axis, a negative direction of the x-axis, a positive direction of a z-axis, a negative direction of the z-axis, a positive direction of a y-axis and a negative direction of the y-axis may be defined as a front direction, a rear direction, a top direction, a bottom direction, a right direction and a left direction, respectively. Yet, the x-, y- and z-axis orthogonal coordinates system rotates together according to an installed direction of the locker.

In this case, definitions for a front/rear direction, a top/bottom direction, and a right/left direction may be changeable. Regarding a direction of rotation, with reference to a direction of a thumb of a right hand, a direction indicated by the rest of fingers is defined as a counterclockwise direction. For instance, a counterclockwise direction may be defined by the right handed screw rule with reference to a positive direction of the z-axis.

In order to fix the door 16, which is turned centering on the hinge 18, to the cabinet 10, a locker or lock 30 may be provided. Referring to FIG. 2, the lock 30 may include a latch 40 provided at one of the door 16 and the cabinet 10 and a coupling part (or coupler) 50 provided at the other. The latch 40 may be provided at the door 16 in general, and the coupling part 50 may be provided at the cabinet 10.

The coupling part 50 may include a latch insertion hole 132. The latch insertion hole 132 may be provided at a front side of the cabinet 10. The latch 40 may enter or exit the latch insertion hole 132, and by selectively fixing the latch 40, the door 16 may be fixed.

Before describing the latch 40 and the coupling part 50 in further detail, an operation of the lock of the present embodiment is schematically described as follows. First of all, in case of intending to close the open door, if a force is applied to the door in a cabinet direction, the latch may be fixed in a manner of being inserted in the latch insertion hole.

Secondly, in case of intending to open the closed door, if a force is applied to the door in the cabinet direction, the fixed latch may be unfastened from the inside of the latch insertion hole so as to be pulled out of the latch insertion hole. Thirdly, in case of intending to force the closed door to be opened (e.g., if the door is pulled in a direction opposite to the cabinet direction or an inner side of the door is pushed from the inside of the cabinet), if the door is pulled with a predetermined force, the fixed latch may be unfastened from the inside of the latch insertion hole so as to be pulled out of the latch insertion hole.

Fourthly, if it is necessary to restrict the closed door from being opened, the latch may be set not to be unfastened from the inside of the latch insertion hole, which may be referred to as a locking of the door. In the following description, configurations of the latch 40 and the coupling part 50 and the operational relation between the latch and the coupling part according to the operation of the lock shall be described in order.

Figure 3A:
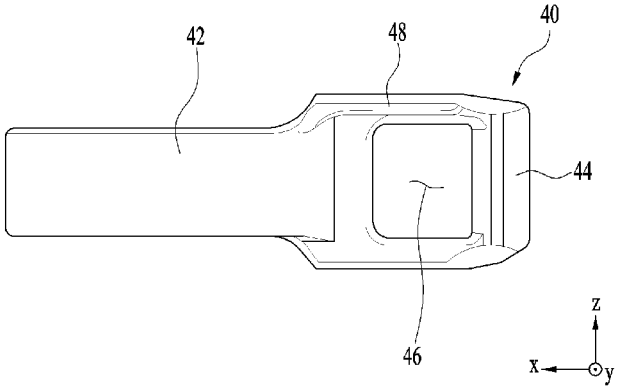
FIGS. 3A-3B are diagrams showing a latch according to an embodiment of the present disclosure.
Figure 3B:
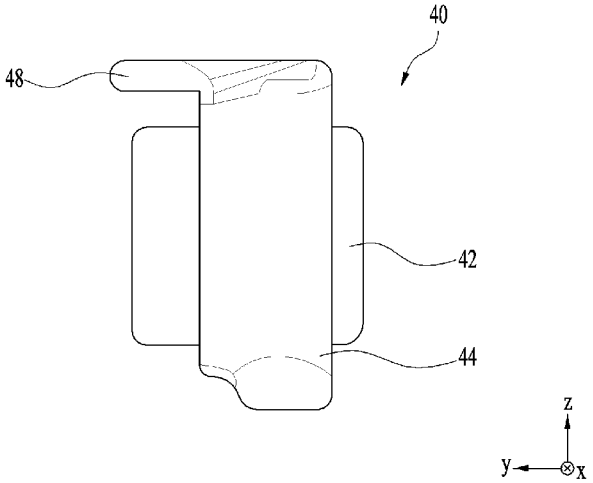

Referring to FIG. 3, the latch 40 may include a latch bar 42 projected from the door 16, a latch head 44 provided at an end of the latch bar 42, a latch hole 46 provided through the latch head 44, and a latch protrusion 48 protruding from the latch hole 46. The latch bar 42 may be provided such that a top-bottom length is greater than a right-left width. The latch head 44 may have a top-bottom length greater than the latch bar 42 and a right-left width smaller than the latch bar 42. Herein, the right-left width means a length in y-axis direction and the top-bottom length means a length in z-axis direction. If the latch 40 is inserted in the latch insertion hole 132, the latch head 44 may rotate an engaging part 200 by pressing a first insertion projection 232 that will be described later.

The latch hole 46 may be provided in the right-left width direction (e.g., y-axis direction) of the latch head 44, and a second insertion projection 234 (described later) may be inserted in the latch hole 46. The latch protrusion 48 may extend from the latch head 44 at a top or bottom side of the latch hole 46 in a first direction (e.g., a positive direction of y-axis), and may preferably be provided at the top side. Herein, the top side means the positive direction of the z-axis and the bottom side means the negative direction of the z-axis.

Figure 4A:
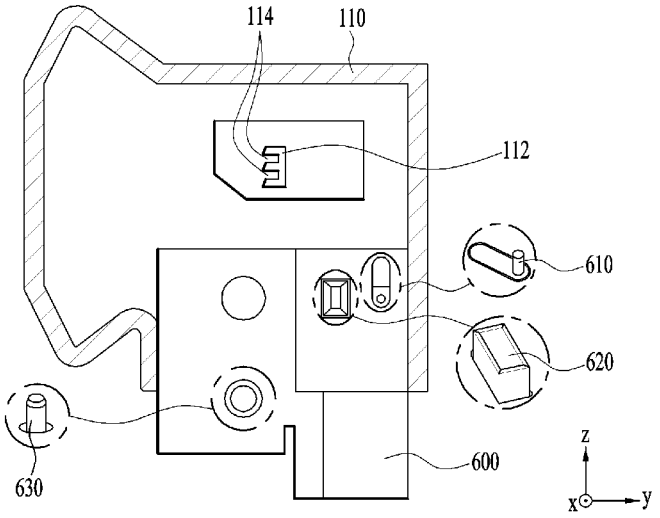
FIGS. 4A-4B are diagrams showing a coupling part according to an embodiment of the present disclosure.
Figure 4B:
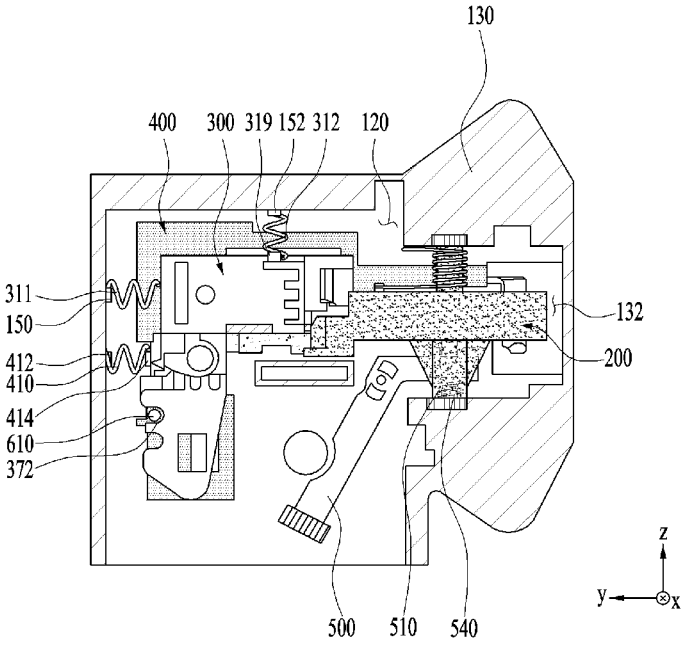

A coupling part 50 may include a rear housing 110 shown in FIG. 4A and a front housing 130 shown in FIG. 4B. The front and rear housings 130 and 110 may be coupled together to form a housing 100. A prescribed space may be provided as an inner space 120 within the housing 100.

The inner space 120 may be formed in the front housing 130 and an open side of the rear may be covered with the rear housing 110. The rear housing 110 may be a cover configured to cover the open side of the front housing.

The rear housing 110 may include a housing stopper 112 capable of restricting the movement of an operating part body 310 that will be described later. The housing stopper 112 may project from an inner surface of the rear housing 110. The housing stopper 112 may include at least one housing stopper recess 114 formed in a direction of the latch insertion hole 132 (i.e., a negative direction of y-axis).

The front housing 130 may include the latch insertion hole 132 formed at the end of the front side. The coupling part 50 may be installed at the cabinet 10 so that the latch insertion hole 132 can be adjacent to the entrance 14. A gap between the entrance 14 and the latch insertion hole 132 may be substantially equal to the thickness of a gasket 15 provided at the door 16, whereby a coupling force of the door by the lock 30 can be raised.

The latch insertion hole 132 may include an insertion hole incline 132*a* formed by inclining in an insertion direction of the latch 40. If the latch 40 is inserted in a manner of being spaced apart by a prescribed distance from the latch insertion hole 132, the insertion hole incline 132*a* may guide the latch head 44 to the latch insertion hole 132 by coming in to contact with the latch head 44.

The latch insertion hole 132 may further include an insertion hole sill 132*b* formed by further inclining than the insertion hole incline 132*a* in the insertion direction of the latch 40. The insertion hole sill 132*b* may guide the latch protrusion 48 by coming in to contact with the latch protrusion 48. Hence, when the latch 40 is inserted in the latch insertion hole 132, an insertion height of the latch 40 may be uniform. When the latch protrusion 48 is provided above the latch head 44, the insertion hole sill 132*b* may be provided above the insertion hole incline 132*a*.

The front housing 130 may include a first shaft guide hole 134 and a second shaft guide hole 136 configured to guide movements of a first shaft 316 and a second shaft 317 of the operating part 300 (described later) in a manner of having the shafts 316 and 317 inserted therein, respectively [cf. FIG. 2]. The first shaft guide hole 134 and the second shaft guide hole 136 may be provided at the front side of the front housing 130 having the latch insertion hole 132 formed therein.

The first shaft guide hole 134 may extend to a first length in a right-left direction. The first shaft 316 may be guided in the right-left direction by the first shaft guide hole 134. The second shaft guide hole 136 may include a second shaft guide hole-1 136*a* extending to a first prescribed length in a right-left direction by being spaced apart from the first shaft guide hole 134 and a second shaft guide hole-2 136*b* extending to a second prescribed length in a top-bottom direction from an end of the second shaft guide hole-1 136*a*.

In the inner space 120 formed within the housing 100, an engaging part (or engaging lever) 200, an operating part (or operating lever) 300, a slider 400, a door open/close sensing part or sensor 500 and an electric device 600 may be accommodated. The engaging part, the operating part, the slider and an error detecting part are described in order with reference to FIGS. 5 to 8 as follows.

Figure 5A:
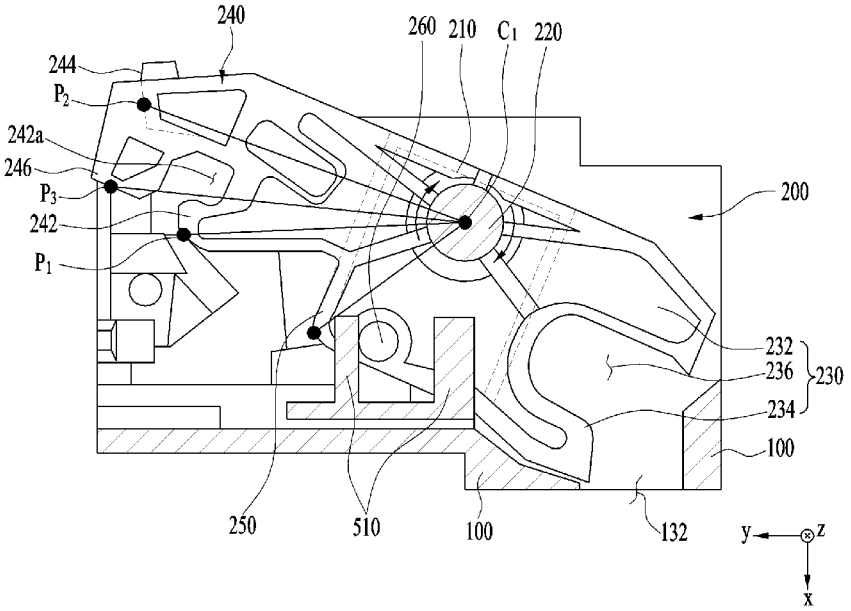
FIGS. 5A-5B are diagrams showing an engaging part according to an embodiment of the present disclosure.

Referring to FIG. 4B and FIG. 5A, the engaging part 200 may be rotatably provided within the housing 100. The engaging part 200 may include an engaging part body 210, an engaging part rotation shaft 220 provided at the engaging part body 210, a latch insertion portion or groove 230 extending from a first end of the engaging part body 210 so as to receive a force by coming in contact with the latch 40, and a pressurizing portion 240 extending from a second end of the engaging part body 210.

The engaging part rotation shaft 220 may extend in a top-bottom direction (i.e., z-axis direction) from a lateral side of the engaging part body 210, and both ends of the engaging part rotation shaft 220 may be rotatably coupled with the housing 100. In order to rotate the engaging part 200 counterclockwise with reference to the top direction (i.e., positive direction of z-axis), an engaging part torsion spring 222 may be provided at the engaging part rotation shaft 220. The engaging part torsion spring 222 may rotate the engaging part 200 in a direction such that the latch insertion portion 230 may approach the latch insertion hole 132.

The engaging part torsion spring 222 may perforate the engaging part rotation shaft 220. One end of the engaging part torsion spring 222 may be fixed to the engaging part body 210 and the other end may be fixed to the housing 100. With reference to the positive direction of z-axis, the engaging part torsion spring 222 may provide an elastic force to the engaging part 200 in a counterclockwise direction. Such a direction may be referred to as a restoration rotation direction of the engaging part 200.

The latch insertion portion 230 may extend to one end of the engaging part body 210 toward a side provided with the latch insertion hole 132. The latch insertion portion 230 may include a first insertion projection 232 extending from the engaging part body 210, a second insertion projection 234 extending from the engaging part body 210 so as to be spaced apart from the first insertion projection 232, and an insertion recess 236 provided between the first insertion projection 232 and the second insertion projection 234.

The first insertion projection 232 may be more distant from the latch insertion hole 132 than the second insertion projection 234. The first insertion projection 232 may extend from a first side of the engaging part body 210, and the second insertion projection 234 may extend from the first side of the engaging part body 210 so as to be spaced apart from the first insertion projection 232. Moreover, an extension length of the second insertion projection 234 may be shorter than that of the first insertion projection 232.

The engaging part rotation shaft 220 may deviate from a center of the engaging part body 210. In this case, the first insertion projection 232 may extend from an end of the engaging part body 210 relatively close to the engaging part rotation shaft 220, and the second insertion projection 234 may extend from an end of the engaging part body 210 relatively distant from the engaging part rotation shaft 220. Centering on the engaging part rotation shaft 220, a portion of the engaging part body 210 from which the second insertion projection 234 extends may be located farther than a portion of the engaging part body 210 from which the first insertion projection 232 extends.

The engaging part rotation shaft 220 may be placed on an extension line of the first insertion projection 232. The engaging part rotation shaft 220 may not be placed on an extension line of the second insertion projection 234. The pressurizing portion 240 may extend from a second end of the engaging part body 210, i.e., the engaging part body 210 located in a direction opposite to the latch insertion portion 230 centering on the engaging part rotation shaft 220.

The pressurizing portion 240 may move the operating part 300 by pushing the operating part 300 when the engaging part 200 is rotated by the latch 40 in a direction opposite to the restoration rotation direction. Hereinafter, a direction in which the pressurizing portion 240 pushes the operating part 300 shall be named a pushing direction.

The pressurizing portion 240 may include a first pressurizing projection (or first projection) 242, a second pressurizing projection (or second projection) 244, and a third pressurizing projection (or third projection) 246. The first pressurizing projection 242, the second pressurizing projection 244, and the third pressurizing projection 246 may differ from each other in length. For instance, the first pressurizing projection 242 may be shorter than the second pressurizing projection 244, the second pressurizing projection 244 may be shorter than the third pressurizing projection 246, and the first pressurizing projection 242 may be shorter than the third pressurizing projection 246.

The first pressurizing projection 242, the second pressurizing projection 244 and the third pressurizing projection 246 may include a first pressurizing point P1, a second pressurizing point P2 and a third pressurizing point P3, which pressurize the operating part 300, respectively. The first to third pressurizing points P1 to P3 may differ from each other in height. For instance, a height of the first pressurizing point P1 may be smaller than that of the second or third pressurizing point P2 or P3, and a height of the third pressurizing point P3 may be smaller than that of the second pressurizing point P2. This is shown in FIG. 5A.

The first to third pressurizing points P1 to P3 may differ from each other in a rotated angle with reference to the engaging part rotation shaft 220. For instance, with reference to the negative direction of z-axis on the engaging part rotation shaft 220, the first pressurizing point P1 is provided at a location rotated counterclockwise further than the third or second pressurizing point P3 or P2 and the third pressurizing point P3 may be provided at a location rotated counterclockwise further than the second pressurizing point P2. This is shown in FIG. 5A as well.

The first to third pressurizing points P1 to P3 may differ from each other in a straight distance from a center C1 of the engaging part rotation shaft 220. For instance, the lengths may gradually decrease in order of a radius of the third pressurizing point P3, a radius of the second pressurizing point P2 and a radius of the first pressurizing point P1. This is shown in FIG. 5A. The rotation radiuses of the first to third pressurizing points P1 to P3 may not overlap with each other.

Figure 5B:
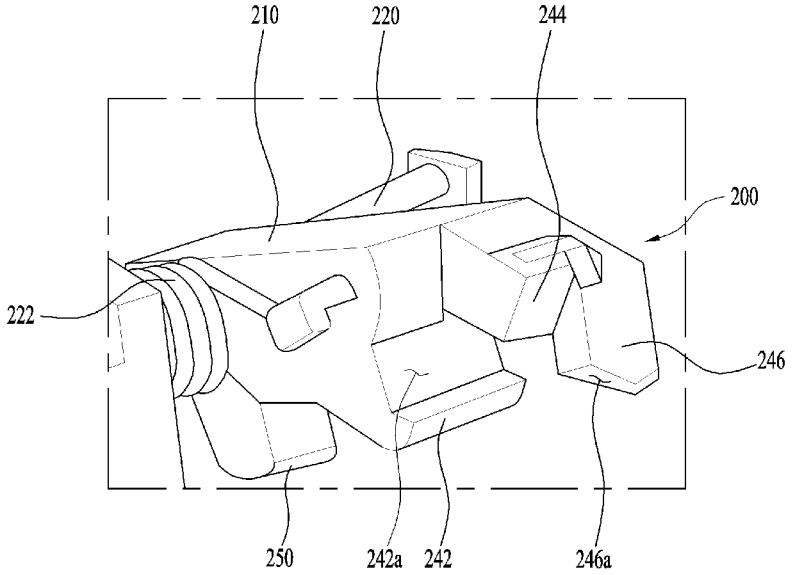

Referring to FIG. 5B, the first pressurizing projection 242 may extend from the engaging part body 210 and may have the same width as the engaging part body 210. Herein, the width of the first pressurizing projection 242 means a length extending in the z-axis direction. A first end of the first pressurizing projection 242 may be rounded so as to move smoothly when contacting a first incline surface 322 of a header (described later).

The second pressurizing projection 244 may be provided at a location further spaced than the first pressurizing projection 242 in a restoration rotation direction. When the right handed screw rule is used with reference to the positive direction of z-axis, as mentioned in the foregoing description, the restoration rotation direction may be the direction indicated by the rest of four fingers. A width of the second pressurizing projection 244 may be smaller than that of the first pressurizing projection 242.

A first pressurizing recess 242*a* may be provided between the first and second pressurizing projections 242 and 244. The first pressurizing recess 242*a* may fix the engaging part 200 while a header 320, which will be described later, is inserted in the recess 242*a* and restricts the engaging part 200 from rotating in the restoration rotation direction.

The third pressurizing projection 246 may extend from the second pressurizing projection 244 in a direction opposite to the restoration rotation direction of the engaging part 200. A width of the third pressurizing projection 246 may be smaller than a width of the first pressurizing projection 242. The third pressurizing projection 246 may be provided on the axis of the engaging part rotation shaft 220 different from the first pressurizing projection 242.

A third pressurizing surface 246*a* may be provided at a first end of the third pressurizing projection 246. A normal line of the third pressurizing surface 246*a* may incline toward the operating part 300. If the third pressurizing surface 246*a* presses the operating part 300, a force may be applied to the operating part 300 in a direction vertical to a pressurizing direction. The operating part 300 may rotate about a first shaft 316, which will be described in detail later.

The engaging part 200 may further include a fourth pressurizing projection (or fourth projection) 250 extending from the engaging part body 210. The fourth pressurizing projection 250 may extend from the engaging part body 210 and may be spaced apart from the first pressurizing projection 242 in a direction opposite to the restoration rotation direction. The fourth pressurizing projection 250 may be provided such that a straight distance from a center C1 of the engaging part rotation shaft 220 is smaller than that of the first pressurizing projection 242. The fourth pressurizing projection 250 may be a stopper of the slider 400 attempting to move in a direction of the latch insertion hole 132 by receiving an elastic force, which will be described in detail with the slider 400.

The operating part 300 may receive a force from the pressurizing portion 240 of the engaging part 200. In this case, the operating part 300 may be capable of a straight motion away from or toward the latch insertion hole 132 (e.g., a case of closing a door, a case of forcing a door to be opened), and a rotational motion centering on the first shaft 316 (e.g., a general case of opening a door). A structure for implementing an operation of the operating part 300 is described as follows.

Figure 6A:
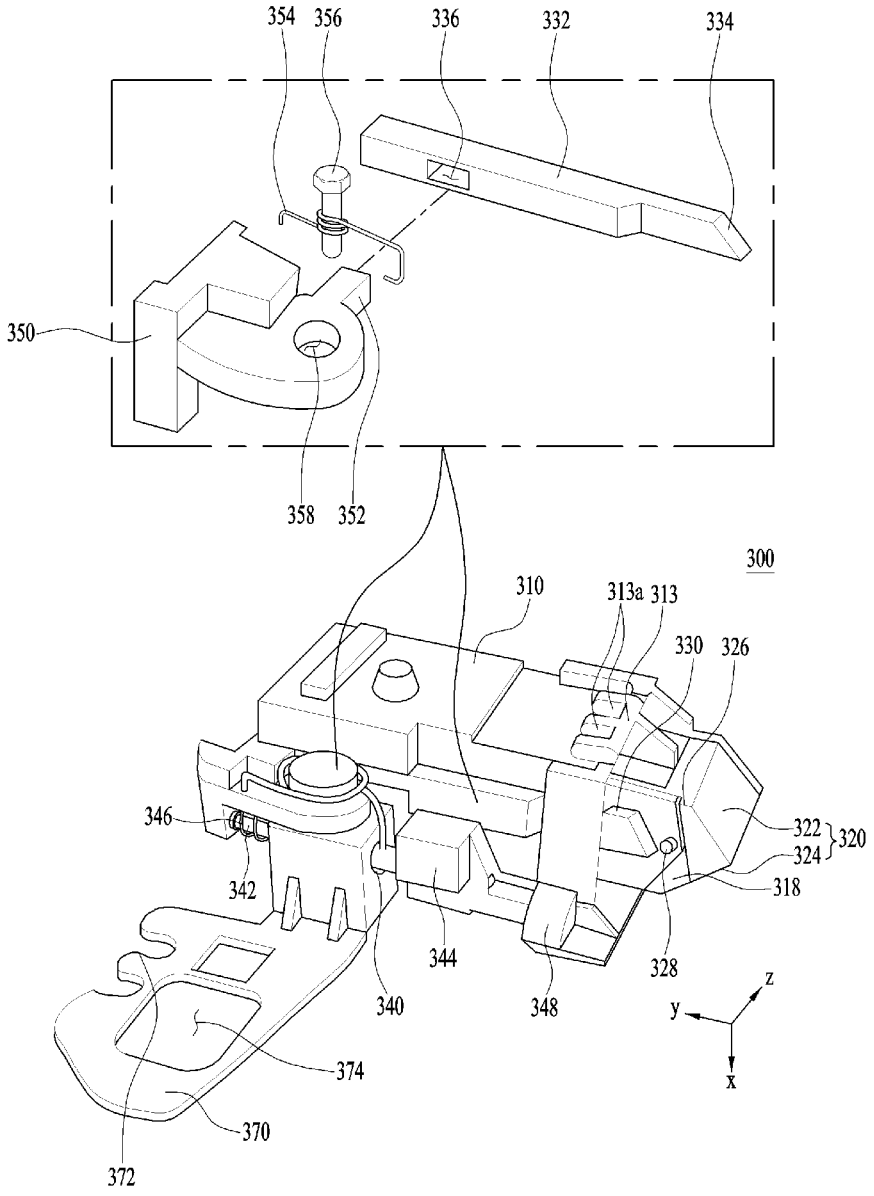
FIGS. 6A-6D are diagrams showing an operating part according to an embodiment of the present disclosure.
Figure 6B:
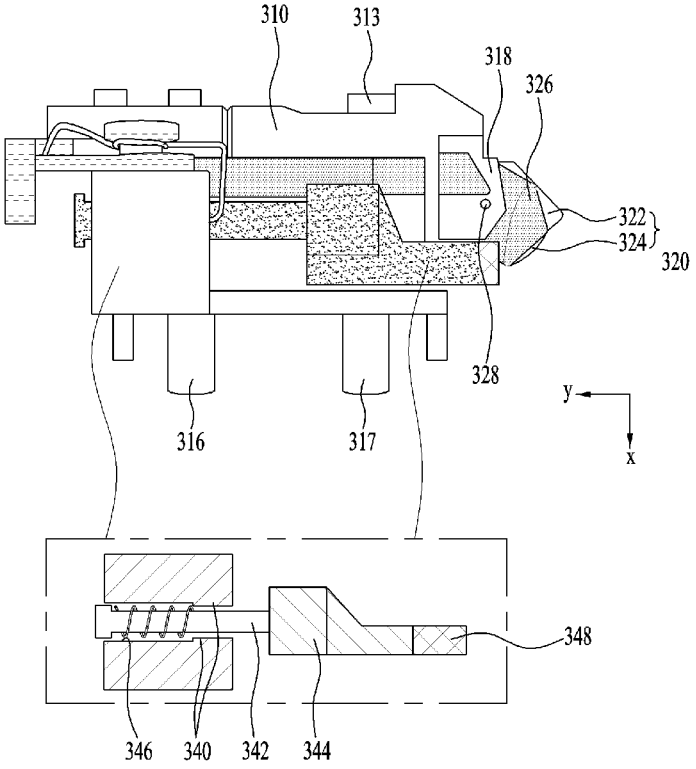

Referring to FIG. 6A and FIG. 6B, the operating part 300 may include an operating part body 310, a header 320 provided at one end of the operating part body 310, a trigger 332, and a release bar 342. The first and second shafts 316 and 317 extending from the operating part body 310 may be provided at a first surface of the operating part body 310. The first and second shafts 316 and 317 may project from a bottom surface (with reference to the drawing of FIG. 6A) of the operating part body 310 in the positive direction of x-axis and may be spaced apart from each other. The first and second shafts 316 and 317 may be inserted in the aforementioned first and second shaft guider holes 134 and 136, respectively, and may become the elements that restrict movement of the operating part 300.

An operating part body stopper 313 may be provided at a second surface of the operating part body 310. The operating part body stopper 313 may project from a top surface (with reference to the drawing of FIG. 6A) of the operating part body 310 in the negative direction of x-axis.

The operating part body stopper 313 may include at least one operating part stopper recess 313*a* extending in a direction (y-axis direction) away from the latch insertion hole 132. The operating part stopper recess 313*a* and the housing stopper recess 114 may be spaced apart from each other in a moving direction of the operating part 300. The operating part stopper recess 313*a* and the housing stopper recess 114 may interact by crossing with each other. Hence, the housing stopper 112 and the operating part body stopper 313 may not restrict mutual motions.

The header 320 may include a first header incline surface 322 and a second header incline surface 324. If the engaging part 200 rotates in a pressurizing direction, the first header incline surface 322 may be pushed by the first pressurizing projection 242. If the engaging part 200 rotates in a restoration rotation direction, the second header incline surface 324 may be pushed by the first pressurizing projection 242. With reference to the drawing of FIG. 6A, the first header incline surface 322 and the second header incline surface 324 may meet the end of the header 320 and the first header incline surface 322 may be provided over the second header incline surface 324.

The header 320 may be rotatably connected to the operating part body 310 by the header shaft 328, and may be provided at the end of the operating part body 310 close to the latch insertion hole 132. The end of the header 320 may fail to further move above the header shaft 328 and rotate at a prescribed angle equal to or smaller than the header shaft 328. In other words, the end of the header 320 may rotate up to the same height of the header shaft 328 only.

A header sill 326 may protrude from a surface vertical to the header shaft 328. The header sill 326 may restrict rotation of the header 320, thereby preventing the end of the header 320 from moving to a location higher than the header shaft 328.

Referring to FIG. 6A, the trigger 332 may be movable to the operating part body 310 in a direction away from or toward the latch insertion hole 132 (i.e., y-axis direction). The trigger 332 may move in a straight movement direction of the operating part 300. The trigger 332 may be provided in form of a bar.

The operating part body 310 may further include a trigger guider (or trigger guide) 330 configured to guide the trigger 332. The trigger guider 330 may be provided at one surface of the operating part body 310, and the trigger 332 may move by penetrating the trigger guider 330.

The trigger 332 may include a trigger incline 334 provided at a first end close to the latch insertion hole 132 by inclining downward with reference to a moving direction of the trigger 332. The trigger incline 334 may be provided in the same inclining direction of the first header incline surface 322. The trigger incline 334 may be pushed by the second pressurizing projection 244. In this case, the trigger 332 may move in a direction away from the latch insertion hole 132 (e.g., positive direction of y-axis) by being guided by the trigger guider 330.

The operating part 300 may further include a rotation stopper 350 configured to rotate by communicating with the trigger 332. The rotation stopper 350 may be rotatably connected to the operating part body 310. Since a rotation stopper fixing portion or peg 356 is fixed to the operating part 310 through a rotation stopper perforated hole 358 provided at the rotation stopper 350, the rotation stopper 350 may rotate centering on the rotation stopper fixing portion 356.

A rotation stopper interlocking projection 352 projected from the rotation stopper 350 may be inserted in a trigger communicating hole 336 provided at the trigger 332. Hence, if the trigger 332 moves in a y-axis direction, the rotation stopper 350 may rotate. For instance, as shown in FIG. 6A, if the trigger 332 moves in a direction away from the latch insertion hole 132 (i.e., positive direction of y-axis), a torque may be generated from the rotation stopper 350 so as to rotate clockwise.

Before rotation by the trigger 332, the rotation stopper may restrict the movement of the slider 400 that will be described later. If the rotation stopper 350 rotates by movement of the trigger 332, the rotation stopper 350 may fail to restrict the movement of the slider 400 but the slider 400 may move in the direction of the latch insertion hole 132.

The operating part 300 may further include a rotation stopper torsion spring 354 configured to provide an elastic force to restore the rotation stopper 350 to an original state. Herein, the original state means a state before the rotation stopper 350 rotates in response to a movement of the trigger 332. If the trigger 332 rotates the rotation stopper 350 by moving in a direction away from the latch insertion hole 132, the rotation stopper 350 may rotate to enable the trigger 332 to move in the direction of the latch insertion hole 132. The rotation stopper torsion spring 354 may be penetrated by the fixing portion 356 of the rotation stopper, a first end may be fixed to the rotation stopper 350, and a second end may be fixed to the operating part body 310.

Referring to FIG. 6B, the release bar 342 may be provided at the operating part body 310 to be movable in a direction away from or toward the latch insertion hole 132 (i.e., y-axis direction). The release bar 342 may move in a straight direction of the operating part 300. Moreover, the release bar 342 may preferably be provided as a bar type.

The release bar 342 may be provided under the trigger 332 with reference to FIG. 6B. The release bar 342 may be provided closer to a bottom side of the operating part body 310. The operating part body 310 may further include a release bar guider or guide 340 configured to guide the movement of the release bar 342. The release bar guider 340 may be provided at one surface of the operating part body 310 provided with the trigger guider 330. The release bar 342 may move through the release bar guider 340.

The release bar 342 may provide an elastic restoration force in a direction away from the latch insertion hole 132 (i.e., positive direction of y-axis). To this end, as shown in FIG. 6B, a release bar spring 346 may be provided between an end of the release bar 342 and the release bar guider 340.

The release bar spring 346 may be released by the release bar 342, a first end of the release bar spring 346 may be fixed to an end of the release bar 342 (e.g., an end portion of the release bar located at a side distant from the latch insertion hole 1321), a second end of the release bar spring 346 may be fixed to the release bar guider 340. Hence, if the release bar 342 moves in a direction toward the latch insertion hole 132 (i.e., negative direction of y-axis), the release bar spring 346 may be compressed to generate an elastic force. The elastic force may work as a restoring force to move the release bar 342 in a positive direction of y-axis.

The release bar 342 may be moved by the release bar spring 346 in a direction away from the latch insertion hole 132 (i.e., positive direction of y-axis). In doing so, the release bar stopper 344 may restrict the movement of the release bar 342. The release bar stopper 344 may be provided at an outer circumference of the release bar 342 so as to have a cross-sectional area wider than that of the release bar 342 penetrating the release bar guider 340. The release bar stopper 344 may be fixed to the second end of the release bar 342 (e.g., an end portion of the release bar located closer to the latch insertion hole 132). If the release bar 342 is moved by the release bar spring 346 in a direction away from the latch insertion hole 132, the release bar stopper 344 may be caught on the release bar guider 340 to restrict the movement of the release bar 342.

The operating part 300 may further include a release portion incline 348 pushed by the third pressurizing projection 246. The release portion incline 348 may be provided at the release bar 342, and more particularly, to the second end of the release bar 342 (i.e., an end portion of the release bar located closer to the latch insertion hole 132) or the release bar stopper 344. The release portion incline 348 may be inclined on a lateral surface of the operating part 300, and the third pressing projection 246 may be provided in a normal direction of the release portion incline 348.

When the third pressurizing projection 246 pushes the release portion incline 348 (positive direction of x-axis), a pressurized force may be divided into a vertical drag of pressurizing the release portion incline 348 vertically and a frictional force between the release portion incline and the third pressurizing projection 246. The vertical drag may be further divided into a vertical component (x-axis direction) force and a horizontal component (y-z plane) force.

Since the operating part body 310 is provided within the housing 100 so as not to be moveable in an x-axis direction, the force of the vertical component may fail to contribute to the movement of the operating part body 310. On the contrary, the force of the horizontal component may work on a lateral surface of the operating part body 310 so as to work as a turning force by which the operating part body 310 can be rotated centering on the first shaft 316. In this case, a rotation radius of the operating part body 310 may be restricted by the second shaft 317 guide within the second shaft guider hole 136. If the release portion incline 348 is pushed by the third pressurizing projection 246, the operating part body 310 may receive a force in the z-axis direction and rotate counterclockwise with reference to the negative direction of the x-axis (i.e., direction in parallel with the first shaft).

The operating part body 310 may receive an elastic force from the second spring 312 in a direction opposite to the rotation direction of the operating part body 310 rotated by the third pressurizing projection 246. As shown in FIG. 4B, the second spring 312 may be opposite of the release portion incline 348. A first end of the second spring 312 may be fixed to the second fixing projection 152 provided at the housing 100 and a second end of the second spring 312 may be fixed to the second spring operating part fixing projection 319. If the operating part body 310 is rotated by the pressing force of the third pressurizing projection 246, the second spring 312 may be compressed. If the pressing force of the third pressurizing projection 246 is stopped, the compressed second spring 312 may provide a restoration force to rotationally move the operating part body 310 into an original sate.

Referring to FIG. 4B and FIG. 6A, the operating part body 310 may receive an elastic force by the first spring 311 in the direction of the latch insertion hole 132 (or, negative direction of y-axis). The first spring 311 may be provided at the second end of the operating part body 310, i.e., an opposite side of a portion of the operating part body 310 provided with the header 320. The first spring may be a compressed coil spring and may provide a force of pushing the operating part body 310 in the direction of the latch insertion hole 132.

Figure 6C:
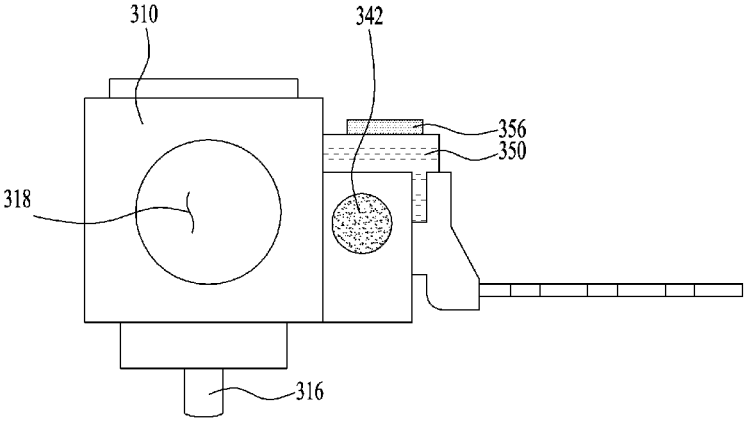

Referring to FIG. 6C and FIG. 4B, a first spring insertion hole 318 may be provide to the operating part body 310 so that a first end of the first spring 311 can be inserted therein. The operating part body 310 may include a first fixing projection 150 projected from the housing 100 so as to fix a second end of the first spring 311 thereto.

Figure 6D:
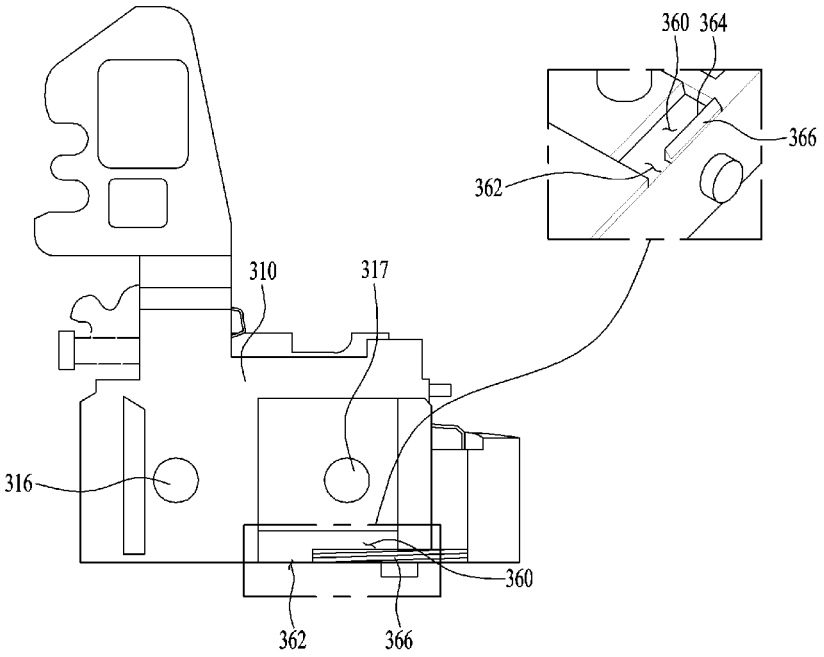

Referring to FIG. 6D, in order to prevent the operating part body 310 from being immediately restored by the second spring 312 after the operating part body 310 has been rotated by the third pressurizing projection 246, the operating part body 310 may further include a rotation delay guider recess (or rotation delay guide recess) 360 configured to delay the restoration rotation of the operating part body 310. The rotation delay guider recess 360 may be provided at a bottom side of the operating part body 310, and may be concave so as to have a prescribed length in a direction away from or toward the latch insertion hole 132.

The rotation delay guider recess 360 may include a rotation delay rib 364 extending from a lateral surface of the operating part body 310 and a rotation delay doorway 362 communicating with the operating part body 310 by cutting the rotation delay rib 364 on a side distant from the latch insertion hole 132. The rotation delay rib 364 may include a rotation delay incline 366 configured to incline downward toward an inside of the rotation delay guider recess 360 from an outside.

If the operating part body 310 is rotated by the pushing of the third pressurizing projection 246, as a slider delay projection 460 (described later) is provided in a rotation radius of the rotation delay incline 366, the rotation delay incline 366 may overstride a top of the slider delay projection 460 and the slider delay projection 460 may be inserted into the rotation delay guider recess 360. Although the operating part body 310 attempts to rotate in an opposite direction, a movement of the rotation delay rib 364 may be restricted by the slider delay projection 460. In order for the slider delay projection 460 to be withdrawn from the rotation delay guider recess 360, one of the slider 400 and the operating part body 310 may make a relative motion so that the slider delay projection 460 can be withdrawn externally through the rotation delay doorway 362.

As the slider delay projection 460 moves toward the rotation delay doorway 362 by moving into the rotation delay guider recess 360, the slider delay projection 460 may be withdrawn externally through the rotation delay doorway 362. Thereafter, the operating part body 310 may be rotated by the second spring 312 in an opposite direction (e.g., direction of returning to a state before rotating by being pushed by the third pressurizing projection 246).

Referring now to FIG. 6A, the operating part 300 may include an operating part wing 370 extending from the operating part body 310. The operating part wing 370 may be a plate member extending from a lateral surface of the operating part body 310 and may be perforated to form an operating part wing hole 374 therein. An operating part locking portion or tab 372 may be further provided at one side of the operating part wing 370.

The operating part wing hole 374 may selectively communicate with a slider wing hole 452 (described later), thereby locking the closed door 16 not to be opened by a force of pushing or pulling the door. The operating part locking portion 372 may be a portion on which a force of rotating the operating part body 310 works so that the operating part wing hole 374 and the slider wing hole 452 can communicate with each other. The operating part locking portion 372 may have a concave recess or a convex projection.

The operating part wing 370 may extend from the operating part body 310 in a bottom direction (cf. FIG. 4B) or a negative direction of z-axis, the operating part wing hole 374 may be formed in a front-rear direction of an x-axis direction, the operating part locking portion 372 may be provided at one side of the operating part wing 370, and the operating part body 310 may be rotated in the same direction of rotating the operating part body 310 by the third pressurizing projection 246. The operating part body 310 may be rotated in a counterclockwise direction with reference to the negative direction of x-axis.

Figure 7:
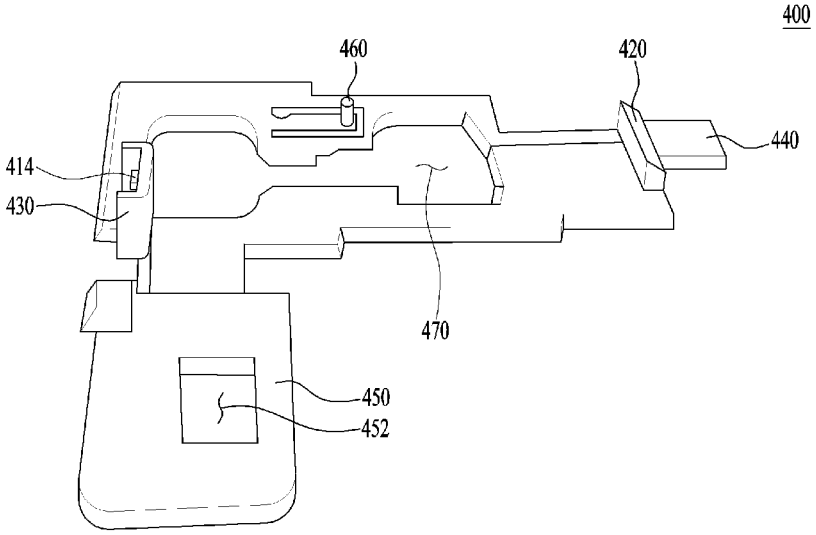
FIG. 7 is a diagram showing a slider according to an embodiment of the present disclosure.

Referring to FIG. 4B and FIG. 7, the slider 400 may include a plate type member provided between the operating part 300 and the front housing 100. The slider 400 may include a slider penetrated hole 470 penetrated by the first and second shafts 316 and 317 extending from the operating part body 310. Hence, the movement of the operating part body 310 and the movement of the slider 400 may not interfere with each other.

As shown in FIG. 4B, the slider 400 may receive an elastic force from the slider spring 410 in a direction of the latch insertion hole 132 within the housing 100. A first end of the slider spring 410 may be fitted into a slider spring fixing projection 414 provided at a first end of the slider 400 distant from the latch insertion hole 132, and a second end of the slider spring 410 may be fitted into a third fixing projection 412 projected from an inner circumference of the housing 100 opposing the end of the slider 400.

If the slider 400 moves in a direction away from the latch insertion hole 132, the slider spring 410 may be compressed. An elastic force of the slider spring 410 may work as a restoration force to move the slider 400 toward the latch insertion hole. Referring to FIG. 7, the slider 400 may include a first slider stopper 420 projected from a second end of the slider 400 adjacent to the latch insertion hole 132 in a direction vertical to a plate type of the slider 400 and a slider extension portion 440 projected in a horizontal direction.

The first slider stopper 420 may move the slider 400 in the direction away from the latch insertion hole 132 by being pushed in a manner of coming in contact with the aforementioned fourth pressurizing projection 250. If the latch insertion portion 230 is rotated in the direction of the latch insertion hole 132 by an elastic force of the engaging part torsion spring 222, the fourth pressurizing projection 250 may push one surface of the first slider stopper 420 (e.g., face close to the latch insertion hole 132) and the slider 400 may move in a direction receding from the latch insertion hole 132.

In this case, the slider spring 410 may provide an elastic force of moving the slider 400 in the direction of the latch insertion hole 132. However, since the elastic restoration force of the engaging part torsion spring 222 is stronger than that of the slider spring 410, the slider 400 may move in the direction away from the latch insertion hole 132 (or, positive direction of y-axis).

If the engaging part 200 is rotated by inserting the latch 40, since the fourth pressurizing projection 250 is unable to further push the first slider stopper 420, the slider 400 may be moved by the elastic force of the slider spring 410 in the direction of the latch insertion hole 132. When the first slider stopper 420 is not push by the fourth pressurizing projection 250, i.e., when the engaging part is not rotated despite the elastic restoration force by the engaging part torsion spring 222 is working owing to the header 320 coupled with the first pressurizing recess 242*a* by the rotated engaging part 200, the slider extension portion 440 may determine whether the door is closed in a manner of normally inserting the latch 40 in the latch insertion hole 132 and inserting the second insertion projection 234 in the latch hole 46.

When the first slider stopper 420 is not pushed by the fourth pressurizing projection 250, the slider extension portion 440 may be exposed by being exposed up to a moving path of the latch 40 from the latch insertion hole 132. When the door 16 is normally closed, the latch may be inserted in the latch insertion hole 132 and the latch protrusion 48 may push the slider extension portion 440 so as to push it in a direction receding from the latch insertion hole.

A location of the slider 400 when (normally closed door) the latch 40 is normally inserted in the latch insertion hole 132 may be provided closer to the latch insertion hole than that of the slider 400 when (open door) the first slider stopper 420 is pushed by the fourth pressurizing projection 250 or further than that of the slider 400 in a state (abnormally closed door) that the latch 40 is not normally inserted and that the first slider stopper 420 is not pushed by the fourth pressurizing projection 250. This may determine a location of the slider wing hole 452 (described later) provided at the slider 400. The reason for this is to further perform a process for locking the door as well as for closing the door 16 in order to operate the home appliance.

The door locking should be performed in the normal door closed state only but not be performed in the door open state or the abnormal door closed state. To this end, it may be determined whether the door currently corresponds to the normal door closed state, the door open state, or the abnormal door closed state according to a location of the slider wing hole 452 provided at the slider 400.

The slider 400 may further include a second slider stopper 430 provided at the first end of the slider 400 distant from the latch insertion hole 132 by vertically protruding from the plate type member. The second slider stopper 430 may be located in a direction opposite to the first slider stopper 420 centering on the slider perforated hole 470. A slider spring fixing projection 414 may be provided at the second slider stopper 430 by projecting in a direction away from the latch insertion hole 132.

The second slider stopper 430 may restrict a movement of the rotation stopper 350 an external force is not applied to the rotation stopper 350 (e.g., a state that an elastic force by the rotation stopper torsion spring 354 is smallest, an original state that the rotation stopper 350 is not rotated by the trigger 332). In other words, although the slider 400 may move by receiving an elastic force in the direction of the latch insertion hole 132 from the slider spring 410, as the movement of the second slider stopper 430 is restricted by the rotation stopper 350, the movement of the slider 400 may be restricted as well. This may occur when the fourth press projection 250 does not pressurize the first slider stopper 420.

The slider 400 may further include the slider delay projection 460 vertically projected from the plate type member. The slider delay projection 460 may be provided in a rotation radius of the rotation delay guider recess 360 provided at the bottom side of the operating part body 310. The slider delay projection 460 may be guided into the rotation delay guider recess 360 by overstriding the rotation delay incline 366. In doing so, the slider delay projection 460 may be damaged. To prevent this, as shown in FIG. 7, a periphery of the slider delay projection 460 may be cut but a prescribed side may be connected, in order to give elasticity to the slider delay projection 460.

The slider 400 may further include a slider wing 450 extending in one direction and the slider wing hole 452 provided at the slider wing. The slider wing 450 may extend in the same direction of the operating part wing 370. The slider wing hole 452 may have a cross-sectional area greater than the operating part wing hole 374.

Figure 8:
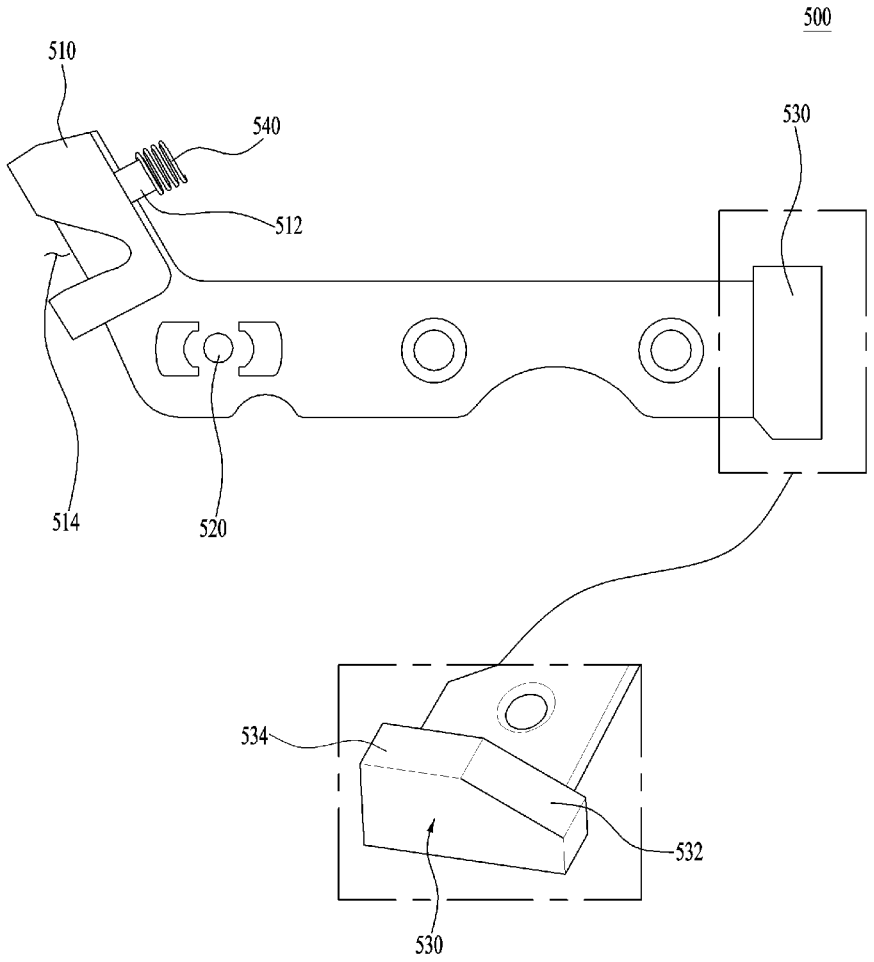
FIG. 8 is a diagram showing a door open/close sensing part according to an embodiment of the present disclosure.

Referring to FIG. 8, a door open/close detecting part or sensor 500 may include a door detection interlocking portion 510 configured to be interlocked with the engaging part 200 and a door detection push portion 530 configured to be interlocked with an electric device 600 described later. The electric device 600 may be a device capable of applying power to the home appliance or locking a closed door in response to opening/closing a door.

As shown in FIG. 4A, the electronic device 600 may include a first detection projection or strike 630 projected externally. If the first detection projection 620 is pushed, it may open an internal electric circuit so as not to supply power to the home appliance. If such a push is released, the projection 630 may short-circuit the internal electric circuit so as to supply power to the home appliance. For another instance, while the first detection projection 630 is projected, as the electric circuit is open, power may be supplied. When the first detection projection 630 is pushed, the electric circuit may be short-circuited.

When the door is open, the door detection push portion 530 may control power not to be supplied to the home appliance by pushing the first detection projection 630. When the door is closed, the door detection push portion 530 may control power to be supplied to the home appliance by enabling the first detection projection 630 not to be pushed. Hence, it may prevent the home appliance from operating when the door is not closed.

The door open/close detecting part 500 may include the door detection interlocking portion 510 provided within the housing to be rotatable centering on the rotation shaft 520 by extending from the door detection rotation shaft 520 in a direction of the engaging part 200 and a door detection push portion 530 extending in a direction of the first detection projection 630. The door detection push portion 530 may include a push portion top surface 534 and a push portion incline surface 532 provided in a manner of inclining downward from the push portion top surface 534. When the door is open, the first detection projection 630 may be pushed by the push portion top surface 534. When the door is closed, the door detection push portion 530 may be moved so that the first detection projection 630 is moved along the push portion incline surface 532. Subsequently, if the first detection projection 630 passes a threshold point pushed by the push portion incline surface 532, it may be fully projected from the electric device.

The door detection interlocking portion 510 may include an interlocking recess 514 in which the engaging part interlocking projection 260 extending from the engaging part 200 may be inserted. Hence, the interlocking recess 514 may be moved by the engaging part interlocking projection 260 together in response to the rotation of the engaging part 200, and the door open/close detecting part 500 is rotated centering on the door detection rotation shaft 520.

In order to prevent the engaging part interlocking projection 260 from escaping from the interlocking recess 514, a door detection spring 540 configured to push a rear side of the interlocking recess 514 may be provided. A first end of the door detection spring 540 may be fixed to the housing 100, and a second end may be fixed by being fitted into the door detection fixing projection 512 provided at the door detection interlocking portion 510.

As shown in FIG. 4A, the electric device 600 may include a first locking projection 610 externally projected to be movable in a top-bottom direction by an internal electric circuit and a second locking projection 620 configured to be selectively projected outward only if the first locking projection 610 is located at a specific position. In order to move the first locking projection 610, the electric device 600 may further include a solenoid inside. For instance, if current is supplied to the solenoid, the locking projection 610 may move downward.

If the operating part locking portion 372 provided at the operating part wing 370 is provided as a recess, the first locking projection 610 may be inserted in the operating part locking portion 372. Hence, when the first locking projection 610 moves downward, the operating part locking portion 372 may also receive a downward force, which may generate a rotation force to rotate the operating part wing 370 and the operating part body 310. Thus, the operating part body 310 may be rotated at a prescribed angle.

If the first locking projection 610 moves downward, the second locking projection 620 may be projected from the electric device 600. If the first locking projection 610 moves upward, the second locking projection 620 is led into an inside of the electric device 600. If the operating part wing hole 374 and the slider wing hole 452 communicate with each other at a certain position (from which the second locking projection 620 is projected), the second locking projection 620 may be inserted by penetrating the operating part wing hole 374 and the slider wing hole 452 both. For instance, the second locking projection 620 may be movable by the deformation of bimetal provided within the electric device 600.

Figure 9A:
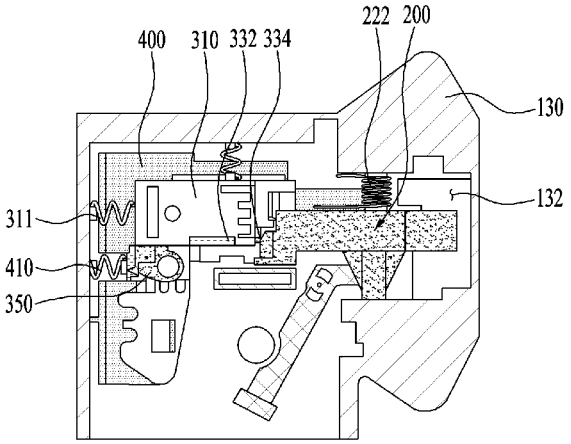
FIGS. 9A-9C are diagrams showing a state that a door is open.
Figure 9B:
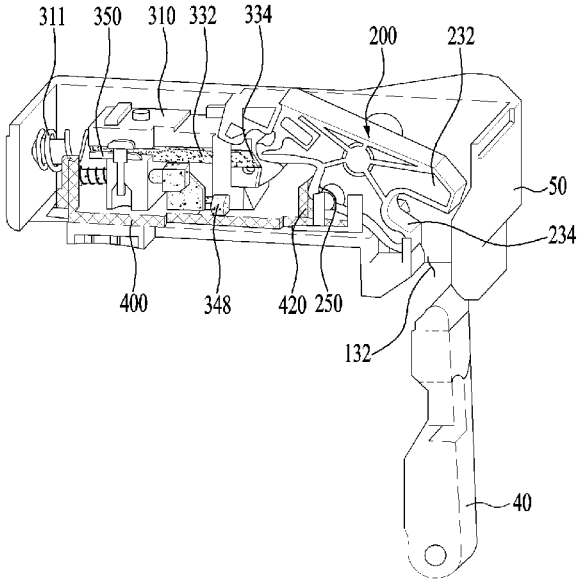

Referring to FIG. 9A and FIG. 9B, an open door state refers to a state before inserting the latch 40 in the latch insertion hole 132. The engaging part 200 may receive an elastic force by the engaging part torsion spring 222 in order for the first and second insertion projections 232 and 234 to rotate in a direction of the latch insertion hole 132.

Since the fourth pressurizing projection 250 pushes the first slider stopper 420 in a direction away from the latch insertion hole 132, the slider 400 may move away from the latch insertion hole as well. Although the slider 400 receives the elastic force in the direction of the latch insertion hole 132 from the slider spring 410, since the elastic force of the slider spring 410 is smaller than that of the engaging part torsion spring 222, the slider spring 410 may be in a maximally compressed state in a door open state. Although the operating part 300 receives the elastic force in the direction of the latch insertion hole 132 from the first spring 311, its motion may be restricted by the first and second shafts 316 and 317 provided at the operating part 300.

Figure 9C:
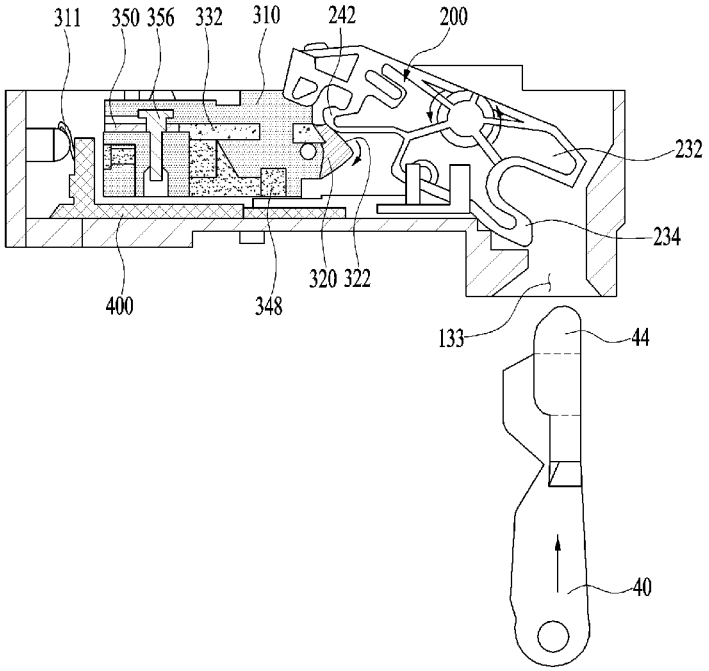

Referring to FIG. 9C, if the latch head 44 is inserted in the latch insertion hole 132, since the latch protrusion 48 is guided by the insertion hole sill 132*b* provided at the latch insertion hole 132, the latch 40 may be inserted in the latch insertion hole 132 at a uniform height. The latch head 44 may push the first insertion projection 232 in a direction away from the latch insertion hole 132 by coming in contact with the first insertion projection 232. If a force by the latch head 44 is greater than the elastic force of the engaging part torsion spring 222, the engaging part 200 may be rotated in a direction opposite to an elastic force direction of the engaging part torsion spring 222.

If the latch 40 is fully inserted in the latch insertion hole 132, the second insertion projection 234 may be inserted inside the latch hole 46, thereby fixing the latch 40 so as not to be withdrawn from the latch insertion hole 132. The first pressurizing projection 242 of the engaging part 200 may press the header 320 of the operating part 300. Specifically, the first pressurizing projection 242 pushes the first header incline surface 322.

Since the header 320 is provided at one end of the operating part body 310 so as to be rotatable in the direction of the latch insertion hole 132 only, the header 320 pressurized by the first pressurizing projection 242 may rotate and the first pressurizing projection 242 may continue to rotate along the first header incline surface 322. In this case, the operating part 300 may move in a direction away from the latch insertion hole 132 and the engaging part torsion spring 222 may be compressed.

Figure 10A:
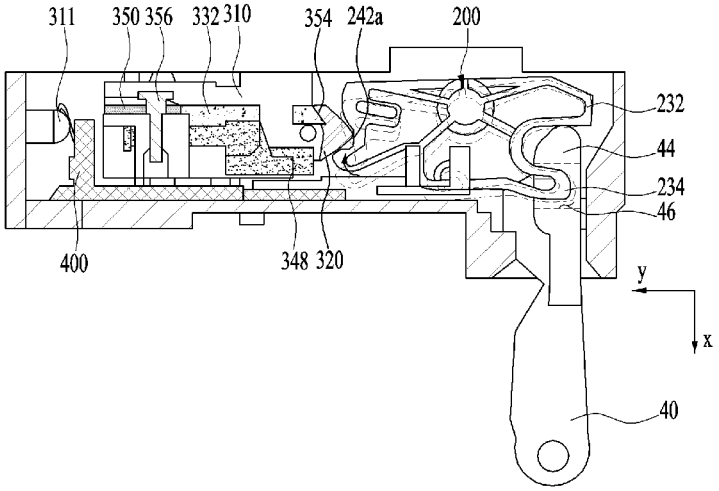
FIGS. 10A-10C are diagrams showing a state that a door is closed.

Referring to FIG. 10A, if the first pressurizing projection 242 goes over an end of the header 320, a force of pushing the header 320 and the operating part 300 may disappear. Hence, the operating part 300 and the header 320 may be moved in the direction of the latch insertion hole 132 by an elastic restoration force of the engaging part torsion spring 222 and the end of the header 320 may be seated on the first pressurizing recess 242*a* of the engaging part 200.

Although the engaging part 200 may move in an original state direction by receiving the elastic force of the engaging part torsion spring 222, since the header 320 may restrict a rotational motion in the opposite direction of the latch insertion hole 132, if a position at which the header 320 cannot rotate is reached, the engaging part 200 may not rotate but may be fixed. Hence, the latch 40 may be fixed by the second insertion projection 234 inserted in the latch hole 46.

Although the second slider stopper 430 receives an elastic force in a direction toward to the latch insertion hole 132 (i.e., negative direction of y-axis) from the slider spring 410, a movement may be restricted by the rotation stopper 350. Before the first pressurizing projection 242 completely goes over an end of the header 320, the second pressurizing projection 244 may pressurize the trigger incline 334 and the trigger 322 may move in a direction away from the latch insertion hole 132 (i.e., positive direction of y-axis). Owing to the movement of the trigger 332, the rotation stopper 350 may rotate.

Thus, as the rotation stopper 350, which has restricted the movement of the second slider stopper 430, rotates, the second slider stopper 430 may be moved in the direction of the latch insertion hole 132 by an elastic force of the slider spring 410. As described above, the second slider stopper 430 may move the release bar 342 in a direction toward to the latch insertion hole 132 (i.e., negative direction of y-axis) by applying a force to the end of the release bar 342. This is because the elastic force of the release bar spring 346 may be smaller than that of the slider spring 410.

Figure 11A:
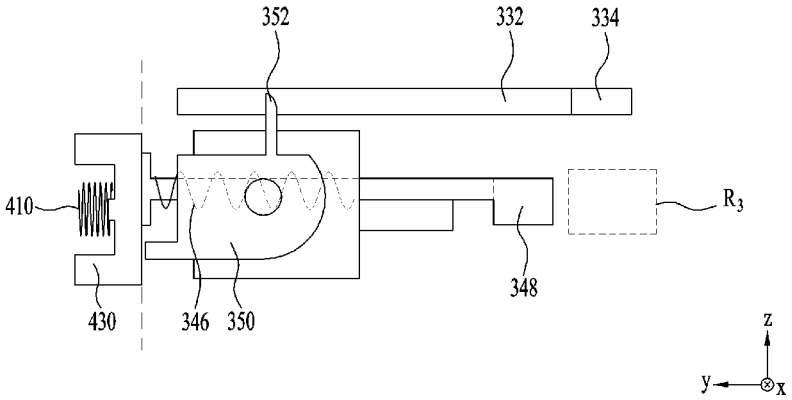
FIGS. 11A-11D are diagrams showing the operational relation among a trigger, a rotation stopper and a release bar.
Figure 11B:
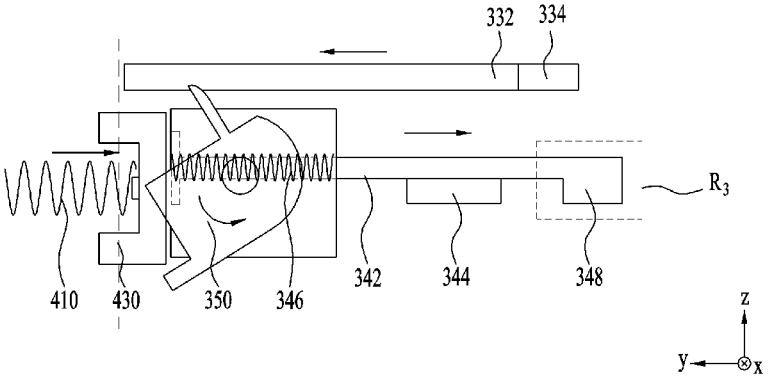

Thus, the release bar incline 348 provided at the end of the release bar 342 may enter a rotation radius R3 of the third pressurizing projection 246. As shown in FIG. 11A, the release bar incline 348 may not enter the rotation radius R3 of the third pressurizing projection 246 until the latch 40 is inserted.

If the third pressurizing projection 246 and the release bar incline 348 interfere with each other in the course of closing the door, since the operating part 300 is rotated, the door may not close. To prevent this, a time interval may be set to enable the release bar 342 to move after completion of rotation of the engaging part 200. The third pressurizing projection 246 may also arrive at a position where the release portion incline 348 arrives by being moved by the second slider stopper 430 earlier. Hence, the release bar incline 348 may not be placed within the rotation radius of the third pressurizing projection 246 in the course of closing the door.

Figure 10B:
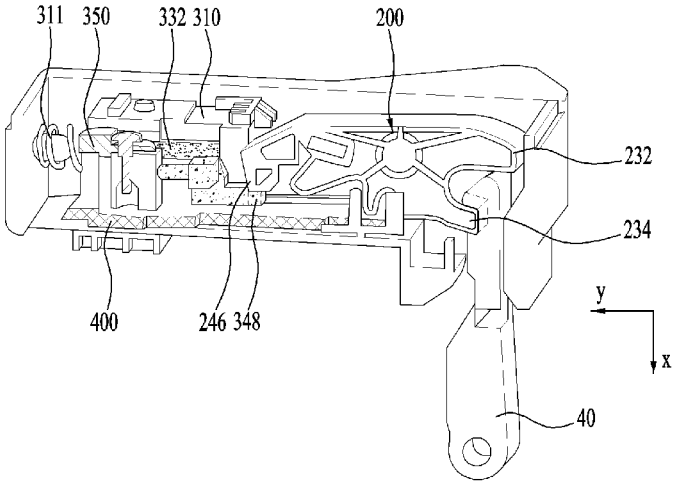
Figure 10C:
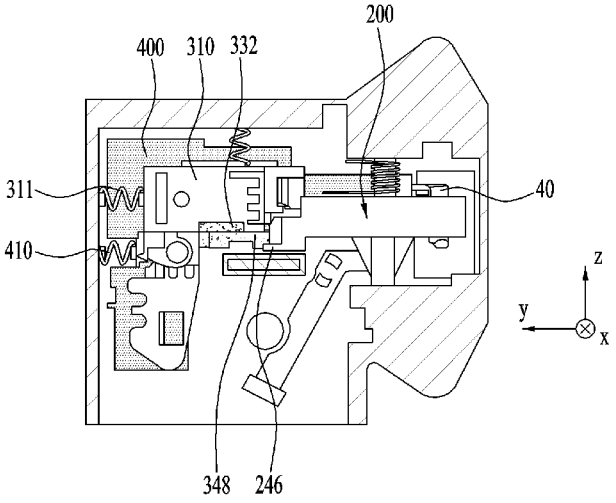

If the door is closed, as shown in FIG. 10B and FIG. 10C, the release bar incline 348 may be provided between the third pressurizing projection 246 and the housing 100. The release bar incline 348 may also be provided in the radius direction of the third pressurizing projection 246. The release bar incline 348 may also be placed in a pressing direction of the third pressurizing projection 246. If the door is closed, the second insertion projection 234 may be inserted in the latch hole 46 so as to fix the latch 40 and the door closed state can be maintained.

Comparing FIG. 9A and FIG. 10C, there is a difference in a position of the slider 400. As shown in FIG. 9A, since the second slider stopper 430 is pressed by the third pressurizing projection 246 in the door open state, the slider 400 may be distant from the latch insertion hole 132. On the contrary, as shown in FIG. 10C, since the slider extension portion 440 is pressed by the latch protrusion 48 in the door closed state, although the slider 400 moves in the away from the latch insertion hole 132, a position of the slider 400 may be closer to the latch insertion hole 132 in comparison with the door open state.

Figure 12A:
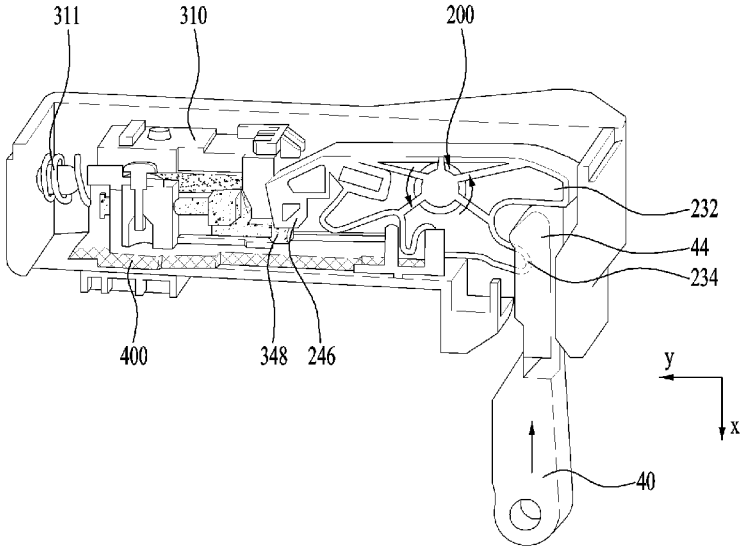
FIGS. 12A-12B are diagrams showing that a door is normally opened in the present disclosure.
Figure 12B:
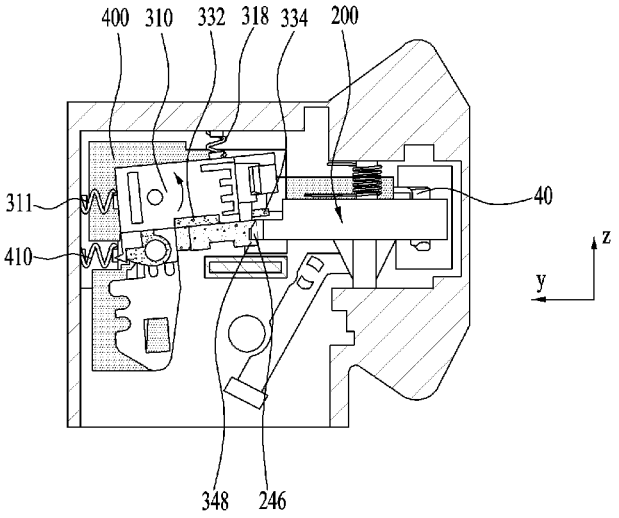

Referring to FIG. 12A, if a front side of the door 16 is pushed to open the door, the latch 40 may move in a direction of being inserted in the latch insertion hole 132 (i.e., negative direction of x-axis) and rotate the engaging part 200 in an opposite direction of an elastic force direction of the engaging part torsion spring 222 (i.e., counterclockwise with reference to negative direction of z-axis). The third pressurizing projection 246 provided relatively lower than the first or second pressurizing projection 242 or 244 may push the release portion incline 348. By the force of pushing the release portion incline 348, as shown in FIG.

12B, the release portion incline 348 and the operating part body 310 may make rotational motions.

The movement of the operating part 300 may be limited to a straight motion in a direction away from or toward the latch insertion hole 132 within the housing by the first shaft 316 and the second shaft 317 and a rotational motion in a direction guided by the second shaft with reference to the first shaft 316 as a reference point. The force of pressing the release portion incline 348 may contribute to the rotational motion of the operating part 300 only.

Owing to the rotation of the operating part 300, the header 320 may deviate from the rotation radius of the first pressurizing projection 242. Since the header 320 that used to press the first pressurizing projection 242 disappears, the header 320 may rotate into an original state using the elastic force by the engaging part torsion spring 222 as a restoration force.

Figure 11C:
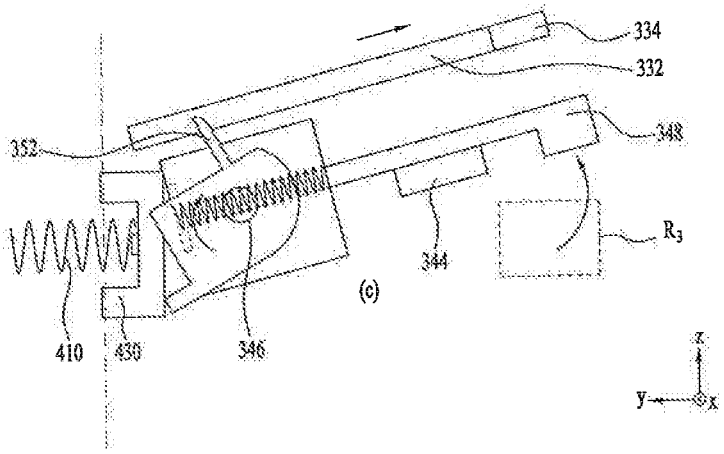
Figure 11D:
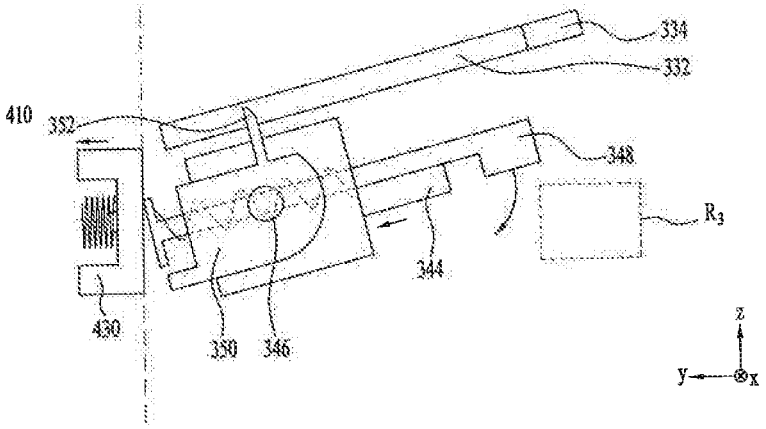

FIG. 11C shows a state that the release portion incline 348 and the operating part 300 are rotated by the third pressurizing projection 246. Owing to the rotation of the operating part 300, the pressurizing force of the second pressurizing projection 244 that used to work on the trigger incline 334 may be removed. This is because the trigger incline 334 may escape from the rotation radius of the second pressurizing projection 244 owing to the rotation of the operating part 300. Thus, the trigger 332 may receive a restoration force from the rotation stopper torsion spring 354 provided at the rotation stopper 350 and move to an original state.

As the latch 40 is withdrawn from the latch insertion hole 132, the engaging part 200 may rotate into an original state by the elastic force of the engaging part torsion spring 222. Thus, the fourth pressurizing projection 250 of the engaging part 200 may re-pressurize the first slider stopper 420 so as to move the slider 400 in a direction away from the latch insertion hole 132. In this case, the operating part 300 may rotate into an original state using the elastic force of the second spring 312 as a restoration force.

A time interval may be set between the movement of the slider 400 and the rotation for the operating part 300 to return to an original state. The slider delay projection 460 may be located in the rotation radius of the rotation delay rib 364 in case that the operating part 300 is rotated by the third pressurizing projection 246.

Particularly, the slider delay projection 460 may enter the rotation delay guider recess 360 by a relative movement of the rotation delay rib 364. In this case, although the operating part attempts to rotate to restore by the second spring 312, the rotation delay rib 364 may be unable to rotate due to the slider delay projection 460.

The slider delay projection 460 may be withdrawn externally through the rotation delay doorway 362 provided at one end of the rotation delay guider recess 360 while moving within the rotation delay guider recess 360 (e.g., while the slider is moving by the fourth pressurizing projection 250). In doing so, the restoration rotation of the operating part 300 may be restricted but the slider 400 may move. Hence, after the movement of the slider 400 has been preceded, the restoration rotation of the operation part 300 may be performed in a manner of leaving a prescribed time interval.

Figure 13:
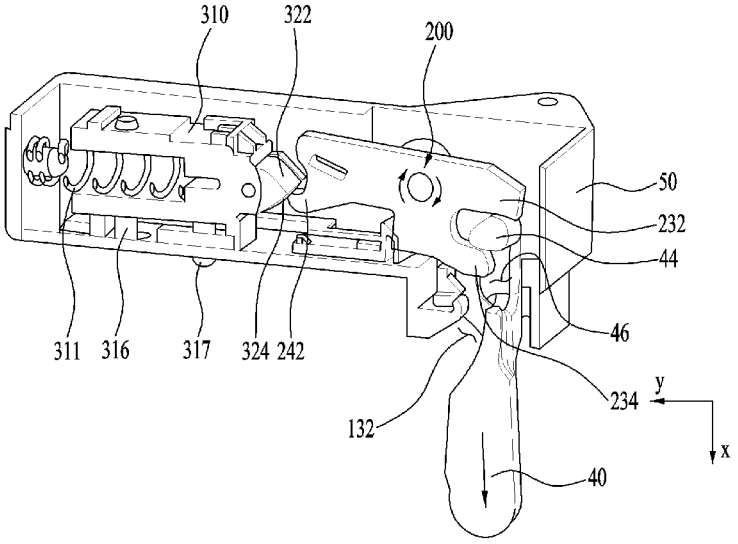
FIG. 13 is a diagram showing that a door is forced to be opened in the present disclosure.

Referring to FIG. 13, if the door is forced to be pulled, the latch 40 may move in a direction of being withdrawn from the latch insertion hole 132 (i.e., positive direction of x-axis). Since the second insertion projection 234 is already inserted in the latch hole 46, the second insertion projection 234 may move in the direction of the latch insertion hole 132, thereby moving the engaging part 200 in the elastic force direction of the engaging part torsion spring 222.

Although the second header incline surface 324 seated at the first pressurizing recess 242*a* may be pressed by the first pressurizing projection 242, since the rotation of the header 320 is restricted, the operating part 300 may make a straight movement in a direction away from the latch insertion hole 132. If the first pressurizing projection 242 passes the threshold point over the end of the header 320, the engaging part 200 may be fully rotated into the door open state by the engaging part torsion spring 222. Hence, the second insertion projection 234 may be withdrawn from the latch hole 46 and the latch 40 may be fully withdrawn from the latch insertion hole 132 as well.

Figure 14A:
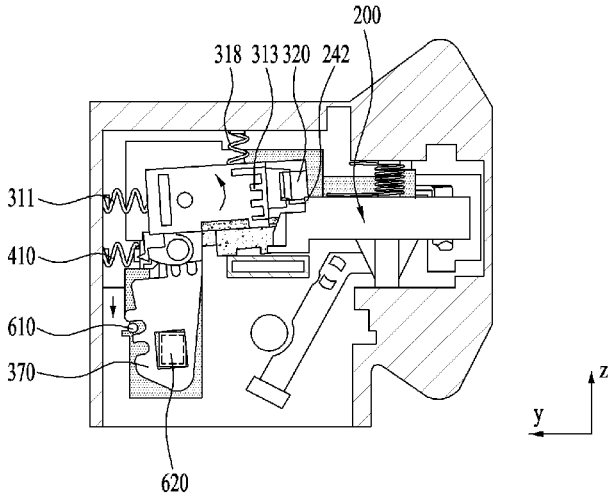
FIGS. 14A-14B are diagrams showing a state that a closed door is locked in present disclosure.

Referring to FIG. 14A, when the home appliance is operating or if it is determined that it is necessary to lock a closed door, the first locking projection 610 projected from the electric device 600 may be moved downward. The first locking projection 610 may be interlocked with the operating part locking portion 372 provided at the operating part wing 370. If a recess is provided at the operating part locking portion 372, the first locking projection 610 may be inserted in the recess of the operating part locking portion 372. Hence, if the first locking projection 610 is moved downward, a force may be delivered to the operating part locking portion 372 and the operating part wing 370 and the operating part 300 may be rotated in a direction that the second shaft 317 is above the first shaft 316 with reference to the first shaft 316 (i.e., positive direction of z-axis) or a counterclockwise direction for a negative direction of x-axis centering on the first shaft.

A rotation angle of the operating part 300 by the first locking projection 610 may be smaller than that of the operating part 300 by the third pressurizing projection 246. Particularly, if the operating part is rotated by the third pressurizing projection 246, the header 320 may deviate from the rotation radius of the first pressurizing projection 242. If the operating part 300 is rotated by the first locking projection 610, the header 320 may still be placed in the rotation radius of the first pressurizing projection 242. Hence, the door may not be released by moving the first locking projection 610 downward.

Figure 14B:
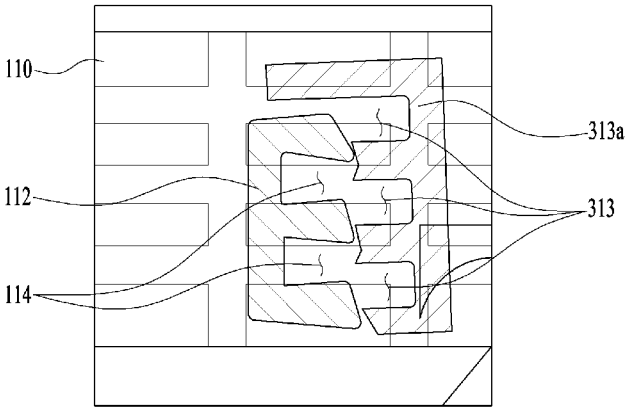

As shown in FIG. 14B, if the operating part 300 is rotated by the first locking projection 610, the operating part body stopper 313 provided at the rotated operating part 300 may be placed on a moving trajectory of the housing stopper 112 provided at the housing. Hence, if the door is pulled to force to be opened (a case that the latch is pulled in a direction of being withdrawn from the latch insertion hole), the operating part 300 may receive a force of moving in a direction away from the latch insertion hole 132. The movement of the operating part 300 may be restricted due to the interference between the operating part body stopper 313 and the housing stopper 112. Hence, it is unable to force the door to be opened.

When forcing the door to be opened, the body stopper 313 and the housing stopper 112 may enable the door to be opened by appropriately changing rigidity, thickness and the like. Namely, if a force over a predetermined level works, the operating part body stopper 313 or the housing stopper 112 may be broken so that the door may be opened.

Before the operating part 300 is rotated by the first locking projection 610, the housing stopper recess 114 and the operating part stopper recess 313*a* may cross with each other so as not to engage with each other despite the operating part 300 being moved. The slider wing hole 452 and the operating part wing hole 374 may communicate with each other in order for the second locking projection 620, which is projected from the electric device 600 owing to the rotation of the operating part 300, to be inserted therein. The second locking projection 620 having penetrated both of the slider wing hole 452 and the operating part wing hole 374 may prevent the movement of the operating part 300, thereby preventing the door from being opened.

In order for the projected second locking projection 620 to penetrate both of the slider wing hole 452 and the operating part wing hole 374, positions of the operating part and the slider are important. The position of the slider 400 may be a position at which the door is normally closed and corresponds to a state that the fourth pressurizing projection 250 does not press the first slider stopper 420 and that the latch protrusion 48 is pressing the slider extension portion 440. The position of the operating part may correspond to a state that the header 320 is seated at the first pressurizing recess 242*a* and that the operating part 300 is rotated by the first locking projection 610.

Since the second locking projection 620 is a bimetal and is projected from the electric device, its pressing force may not be significant. Hence, the positions of the operating part and the slider may be placed at the above-mentioned positions, thereby enabling the operating part wing hole 374 and the slider wing hole 452 to communicate with each other.

The home appliance may be set to operate only if the second locking projection 620 is fitted into both of the operating part wing hole 374 and the slider wing hole 452. In this case, as the closed door is locked, it may secure that the door is not opened during the home appliance operation.

A home appliance according to one embodiment may include a cabinet having a storage space formed inside and an entrance communicating with the storage space, a door rotatably coupled with the cabinet to open/close the entrance, a latch provided at one of the door and the cabinet, and a coupling part provided at the other one of the door and the cabinet, the coupling part including a housing including a latch insertion hole which the latch inserted therein, an engaging part including an engaging part body rotatably provided within the housing, a latch insertion portion having an end of the latch inserted therein by extending from one end of the engaging part body, and a pressurizing portion having a first pressurizing projection and a third pressurizing projection by extending the other end of the engaging part body, an engaging part torsion spring provided at the engaging part to provide an elastic force so as to enable the latch insertion portion to rotate in a direction getting close to the latch insertion hole, an operating part configured to move in a direction getting distant from the latch insertion hole by being pressurized by the first pressurizing projection and rotate in a direction vertical to a direction pressurized by the third pressurizing projection, a first spring providing a restoration force to enable the operating part to be restored into a state before being pressurized by the first pressurizing projection, and a third spring providing a restoration force to enable the operating part to be restored into a state before being pressurized by the third pressurizing projection.

The first pressurizing projection may be located closer to the operating part than the third pressurizing projection. The operating part may include an operating part body receiving a force from each of the first spring and the second spring and a header including a first header incline surface provided at an end of the operating part body by inclining downward from the operating part body and a second incline surface connected to an end of the first header incline surface by inclining upward from the operating part body.

If the door is closed, the first pressurizing projection may move the operating part by pressurizing the first header incline surface. If the first pressurizing projection passes an end of the header, a movement of the pressurizing projection may be restricted by the second header incline surface.

A release bar incline configured to be pressurized by the third pressurizing projection may be provided at a lateral surface of the operating part body. Particularly, the release bar incline may incline at a prescribed angle against a direction pressed by the third pressurizing projection and the third pressurizing projection may further include a third pressurizing surface configured to incline to correspond to the release bar incline.

If the door is opened, the third pressurizing projection may rotate the operating part by pressurizing the release bar incline so that the header deviates from a rotation radius of the first pressurizing projection. A length of the third pressurizing projection may be longer than that of the first pressurizing projection. The header may be provided at an end of the operating part to be rotatable centering on a header shaft and an end of the header may fail to rotate over a position higher than the header shaft.

The home appliance may further include a release bar having the release bar incline provided thereto, the release bar provided at be moveable in a direction equal to a moving direction of the operating part if pressed by the first pressurizing projection and a release bar guider provided at the operating part body to guide the release bar. In this case, the release bar may be moved in order for the release bar incline to deviate from a rotation radius of the third pressurizing projection in a state that the door is open. The release bar may be moved in order for the release bar incline to be placed within the rotation radius of the third pressurizing projection in a state that the door is closed.

Terminologies used in the present specification need to be construed based on the substantial meanings of the corresponding terminologies and the overall matters disclosed in the present specification rather than construed as simple names of the terminologies. If a term used in the present specification semantically conflicts with a general meaning of the corresponding term, it may follow the definition used in the present specification.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A home appliance, comprising:

a cabinet having a storage space formed inside and an opening communicating with the storage space;

a door rotatably coupled with the cabinet to open or close the opening;

a latch provided at one of the door and the cabinet; and a coupler provided at the other one of the door and the cabinet, the coupler including:

a housing including a latch insertion hole into which the latch is inserted;

an engaging lever, the engaging lever including an engaging lever body rotatably provided within the housing, a latch insertion groove having an end of the latch inserted therein by extending from a first end of the engaging lever body, and a first projection, a second projection, a third projection, and a fourth projection formed by a plurality of extending portions of a second end of the engaging lever body;

an engaging lever torsion spring provided at the engaging lever to provide an elastic force so as to enable the latch insertion groove to rotate toward the latch insertion hole;

an operating lever configured to move away from the latch insertion hole by being pressed by the first projection and rotate with respect to a first shaft attached to the operating lever;

a first spring providing a restoration force to enable the operating lever to be restored into a state before being pressed by the first projection; and a second spring providing a restoration force to enable the operating lever to be restored into a state before being pressed by the third projection.

2. The home appliance of claim 1, wherein the first projection is located closer to the operating lever than the third projection.

3. The home appliance of claim 2, wherein the operating lever includes:

an operating lever body receiving a force from each of the first spring and the second spring; and a header including a first header inclined surface provided at a first end of the operating lever body inclined downward from the operating lever body and a second inclined surface connected to a first end of the first header inclined surface and inclined upward from the operating lever body.

4. The home appliance of claim 3, wherein if the door is closed, the first projection moves the operating lever by pressing the first header inclined surface, and wherein if the first projection passes a first end of the header, a movement of the first projection is restricted by the second header incline surface.

5. The home appliance of claim 3, wherein a release bar incline configured to be pressed by the third projection is provided at a lateral surface of the operating lever body.

6. The home appliance of claim 5, wherein the release bar incline is inclined at a prescribed angle against a direction pressed by the third projection, and wherein the third projection further includes an inclined surface corresponding to the release bar incline.

7. The home appliance of claim 5, wherein when the door is opened, the third projection rotates the operating lever by pressing the release bar incline so that the header deviates from a rotation radius of the first projection.

8. The home appliance of claim 1, wherein a length of the third projection is longer than that of the first projection.

9. The home appliance of claim 3, wherein the header is provided at the first end of the operating lever to be rotatable centering on a header shaft, and wherein an end of the header does not to rotate over a position higher than the header shaft.

10. The home appliance of claim 5, further including:

a release bar including the release bar incline, the release bar moveable in a same direction as a moving direction of the operating lever when pressed by the first projection; and a release bar guide provided at the operating lever body to guide the release bar, wherein the release bar is moved to allow the release bar incline to deviate from a rotation radius of the third pressurizing projection when the door is open, and wherein the release bar is moved to allow the release bar incline to be placed within the rotation radius of the third projection when the door is closed.

11. A latch lock for a home appliance including a door and a cabinet, the latch lock comprising:

a latch bar protruding from an interior surface of the door and including a latch hole; and a coupler attached to the cabinet and including a latch insertion hole configured to receive the latch bar, wherein the coupler includes:

an engaging lever including an engaging lever body configured to rotate about a first axis when contacted by the latch bar and including a first insertion projection and a second insertion projection extending from a first side of the engaging lever, and a first projection, a second-projection, and a third projection extending from a second side of the engaging lever, wherein the second insertion projection is configured to be inserted into the latch insertion hole when the latch bar is received in the coupler; and an operating lever configured to slide in a first direction and to rotate about a second axis different from the first axis when contacted by the engaging lever and including a header on a first end having a first incline and a second incline configured to interact with the first projection, and a release bar having a release portion incline configured to interact with the third projection, wherein when the door is closed and the latch bar is received in the coupler, the first projection presses the first incline of the header such that the header is received in a recess formed between the first projection and the engaging lever body, and wherein when the door is opened, the third projection pushes the release portion incline such that the operating lever rotates about the second axis to move the header out of the recess.

12. The latch lock of claim 11, further including a first spring attached to a second end of the operating lever and an inside of the casing and configured to push the operating lever toward the latch insertion hole.

13. The latch lock of claim 11, further including a second spring attached to a first side of the operating lever and an inside of the casing and configured to rotate the operating lever to a first position after having been rotated by the third projection.

14. The latch lock of claim 11, wherein the header is rotatable on a header shaft about a third axis parallel to the first axis.

15. The latch lock of claim 11, further including a door open/close sensor configured to sensor whether the door is in an opened state or a closed state depending on a movement of the engaging lever.

16. The latch lock of claim 15, wherein when the engaging lever rotates, the door open/close sensor rotates about a fourth axis parallel to the first axis to contact a first detection projection.

17. The latch lock of claim 11, further including a locking projection configured to penetrate the operating lever when the door is locked to the cabinet.

* * * * *